US008096244B1

(12) United States Patent
Bockheim et al.

(10) Patent No.: US 8,096,244 B1
(45) Date of Patent: Jan. 17, 2012

(54) MODULAR CONFERENCE TABLE

(75) Inventors: Robert J. Bockheim, Grand Rapids, MI (US); James P. Tol, Cedar Springs, MI (US); Matthew O. Schad, East Grand Rapids, MI (US); Todd A. Ratz, Belmont, MI (US); Robert J. Surman, East Grand Rapids, MI (US); Shawn O. Barrett, Libertyville, IL (US); Michael Fedrigo, Comstock Park, MI (US)

(73) Assignee: Nucraft Furniture Company, Comstock Park, MI (US)

( * ) Notice: Subject to any disclaimer, the term of this patent is extended or adjusted under 35 U.S.C. 154(b) by 772 days.

(21) Appl. No.: 12/133,097

(22) Filed: Jun. 4, 2008

Related U.S. Application Data

(60) Provisional application No. 60/933,379, filed on Jun. 6, 2007.

(51) Int. Cl.
*A47B 3/00* (2006.01)
*A47B 57/00* (2006.01)

(52) U.S. Cl. ..... 108/64; 108/115; 108/12

(58) Field of Classification Search ..... 108/115, 108/18, 50.01, 50.02, 63–65, 69, 77, 124, 108/127, 128, 176, 90, 91, 134, 135, 11, 108/12; 248/188.1, 188.6, 166, 165, 436; 312/223.3, 194, 195, 111, 277; 52/36.1
See application file for complete search history.

(56) References Cited

U.S. PATENT DOCUMENTS 373,316 A * 11/1887 Skinner ..... 108/64
1,144,398 A 6/1915 Thommen
1,439,986 A * 12/1922 Wallinder ..... 108/185
1,500,842 A 7/1924 Paulson
1,598,304 A 8/1926 Pearlman
1,688,456 A 10/1928 Dolph
1,719,039 A * 7/1929 Alexander ..... 108/185
1,802,528 A 4/1931 Petrolo
1,930,741 A * 10/1933 Saussure, Jr. ..... 108/64
2,297,647 A * 9/1942 Chason ..... 108/69
2,354,106 A 7/1944 Cooper
2,611,672 A 9/1952 Ohlsson
2,619,394 A 11/1952 Mahr
2,654,650 A 10/1953 Stanton (Continued)

FOREIGN PATENT DOCUMENTS

DE 19541068 * 5/1997

(Continued)

*Primary Examiner* — Janet M Wilkens
(74) *Attorney, Agent, or Firm* — Gardner, Linn, Burkhart & Flory, LLP

(57) ABSTRACT

A modular table and method of assembly comprises a first table having a first table top and a pair of first support legs at opposite end regions of the first table top and a second table having a second table top and a pair of second support legs. The second support legs are adjustably mounted at the second table top and are adjustable relative to the second table top between a support orientation, in which the second support legs support the second table top in a free-standing manner, and a non-support orientation, in which the second support legs do not substantially support the second table top in a free-standing manner. The second table is configured to be secured to the first table when the tables are adjacent to one another. The second support legs are adjustable to the second orientation when the second table is secured to the first table.

28 Claims, 27 Drawing Sheets

U.S. PATENT DOCUMENTS

| | | | | | |
|---|---|---|---|---|---|
| 2,704,236 | A | | 3/1955 | Mahr | |
| 2,723,171 | A | | 11/1955 | Carder | |
| 2,836,475 | A | | 5/1958 | Sapp | |
| 2,857,223 | A | | 10/1958 | Furey | |
| 3,066,993 | A | | 12/1962 | Mark | |
| 3,290,108 | A | | 12/1966 | Beckman et al. | |
| 3,367,290 | A | | 2/1968 | Barecki | |
| 3,521,579 | A | | 7/1970 | Stafford | |
| 3,524,689 | A | | 8/1970 | Wener | |
| 3,652,143 | A | | 3/1972 | Wener | |
| 3,761,152 | A | | 9/1973 | Cory | |
| 3,820,477 | A | | 6/1974 | Griffin | |
| 3,828,695 | A | | 8/1974 | Skarky | |
| 4,158,335 | A | | 6/1979 | Belcastro et al. | |
| 4,217,832 | A | | 8/1980 | Pozzan | |
| 4,645,161 | A | | 2/1987 | Collins | |
| 4,665,836 | A | * | 5/1987 | Burr | 108/64 |
| 4,735,467 | A | | 4/1988 | Wolters | |
| 4,922,835 | A | | 5/1990 | Van Vliet et al. | |
| 5,071,204 | A | | 12/1991 | Price et al. | |
| 5,130,494 | A | | 7/1992 | Simonton et al. | |
| 5,483,900 | A | | 1/1996 | Elzenbeck | |
| D376,059 | S | * | 12/1996 | Bergelin | D6/480 |
| 5,718,179 | A | | 2/1998 | Johnson et al. | |
| 5,794,545 | A | | 8/1998 | McDaniel et al. | |
| 6,000,343 | A | | 12/1999 | Laney | |
| 6,126,253 | A | | 10/2000 | Kelley et al. | |
| 6,170,926 | B1 | | 1/2001 | Roberts et al. | |
| 6,182,580 | B1 | | 2/2001 | Barrett et al. | |
| 6,182,581 | B1 | | 2/2001 | Boyce | |
| 6,283,043 | B1 | | 9/2001 | Stern et al. | |
| 6,327,983 | B1 | | 12/2001 | Cronk et al. | |
| 6,497,184 | B1 | | 12/2002 | Whitesitt | |
| 6,588,866 | B2 | | 7/2003 | Cheng | |
| 6,725,784 | B2 | | 4/2004 | Crinion | |
| 6,997,117 | B1 | | 2/2006 | Mitjans | |
| 2006/0042520 | A1 | | 3/2006 | Stevens et al. | |

FOREIGN PATENT DOCUMENTS

| | | | |
|---|---|---|---|
| JP | 2010029297 | * | 2/2010 |

* cited by examiner

MODULAR CONFERENCE TABLE

CROSS REFERENCE TO RELATED APPLICATIONS

The present application claims priority from U.S. provisional application Ser. No. 60/933,379, filed Jun. 6, 2007, which is hereby incorporated herein by reference in its entirety.

FIELD OF THE INVENTION

The present invention relates generally to conference tables and, more particularly, to conference tables that are assembled together by joining two or more individual tables.

BACKGROUND OF THE INVENTION

Modular tables are known and typically are constructed of a plurality of detachably connected modules to form a desired table. Examples of such tables are described in U.S. Pat. Nos. 6,182,581; 6,497,184; 6,182,580; 6,000,343; and 5,794,545, which are hereby incorporated herein by reference in their entireties. Such modular tables include individual sections that are moved into a desired configuration and may be joined together to form a conference table or the like.

SUMMARY OF THE INVENTION

The present invention provides a modular table, such as a modular conference table, that is assembled by positioning multiple individual tables in a desired configuration and joining the individual tables together. When the tables are joined together, the support legs of at least one of the individual tables or table sections may be moved or pivoted so as to be generally parallel to and along the support legs of at least one other table or table section, such that the legs of the joined table sections appear to be a generally unitary support leg at or near an end of the assembled conference table configuration. The table sections may be secured together at or near an upper portion of the table portions, such as substantially immediately beneath the table tops, so that the table tops are pulled together and the joined table is secured to the other table and does not tip or tilt when its support legs are moved or pivoted so as to be generally at and along the support leg or legs of the other table or table section.

According to an aspect of the present invention, a modular table includes a first table and a second table. The first table has a first table top and a pair of first support legs at opposite end regions of the first table top. The second table has a second table top and a pair of second support legs, with the second support legs being adjustably mounted at the second table top and being movable or adjustable relative to the second table top, such as via pivoting of the support legs about a generally vertical pivot axis or a generally horizontal pivot axis. The second support legs are adjustable between a support orientation, where the second support legs are oriented to support the second table top in a free standing manner (and thus may be arranged generally transverse to a longitudinal axis of the second table top), and a non-support orientation, where the second support legs do not support the second table top in a free-standing manner. The second table is configured to be secured to the first table when the first table is adjacent the second table, whereby the second support legs are adjustable to the second orientation when the second table is secured to the first table, and whereby the second table top is substantially secured relative to the first table top to limit tilting of the second table top relative to the first table top when the second table is secured to the first table and when the second support legs are adjusted to the non-support orientation.

The modular table may comprise a pair of first tables, with the second table being configured to be secured to each of the first tables at perimeter ends thereof. The second table may have a length dimension and a longitudinal axis along the length dimension, and the first table or tables may have a length dimension and longitudinal axis along that length dimension, whereby the second table may be oriented with its longitudinal axis being generally transverse to a longitudinal axis of the first table or tables. The second support legs may be oriented generally parallel to the longitudinal axis of the second table when in the non-support orientation.

The modular table includes a securing element for securing the first table to the second table. Optionally, the securing element may comprise a ratchet element that is actuatable to draw the first table top toward and against the second table top in order to secure the first table relative to the second table. The securing element components are located at the first and second table tops so as to substantially align the table tops and draw them together such that their opposed perimeter edge regions are drawn into substantially flush engagement.

According to another aspect of the present invention, a method of configuring a modular table includes providing first and second tables. The first table has a first table top and a pair of first support legs at opposite end regions of the first table top. The second table has a second table top and a pair of second support legs. The second support legs are adjustably mounted to the second table top and are adjustable relative to the second table top. The second support legs may be oriented in a support orientation for free standing support of the second table top. The first and/or second tables are moved such that a first perimeter region of the first table top is adjacent to a second perimeter region of the second table top. The second table top is secured relative to the first table, and the second support legs are moved relative to the second table top to a non-support orientation so that the second support legs do not substantially support the second table in a free-standing manner. The securement of the second table relative to the first table limits tilting of the second table when the second support legs are moved to the non-support orientation.

Therefore, the modular table of the present invention provides individual, free standing tables with table tops and support legs. When it is desired to form a larger table, such as a conference table or the like, the first and second tables (or more tables of similar construction) are arranged in a desired configuration and joined or secured together. When the second table is secured to the end of the first table, the support legs of the second table may be moved or adjusted or pivoted inward, so as to be generally along and at the end support legs of the first table, so as to provide an aesthetically pleasing conference table having a unitary table appearance with support columns at or near the opposite ends of the table.

These and other objects, advantages, purposes and features of the present invention will become apparent upon review of the following specification in conjunction with the drawings.

DESCRIPTION OF THE PREFERRED EMBODIMENTS

Figure 1:
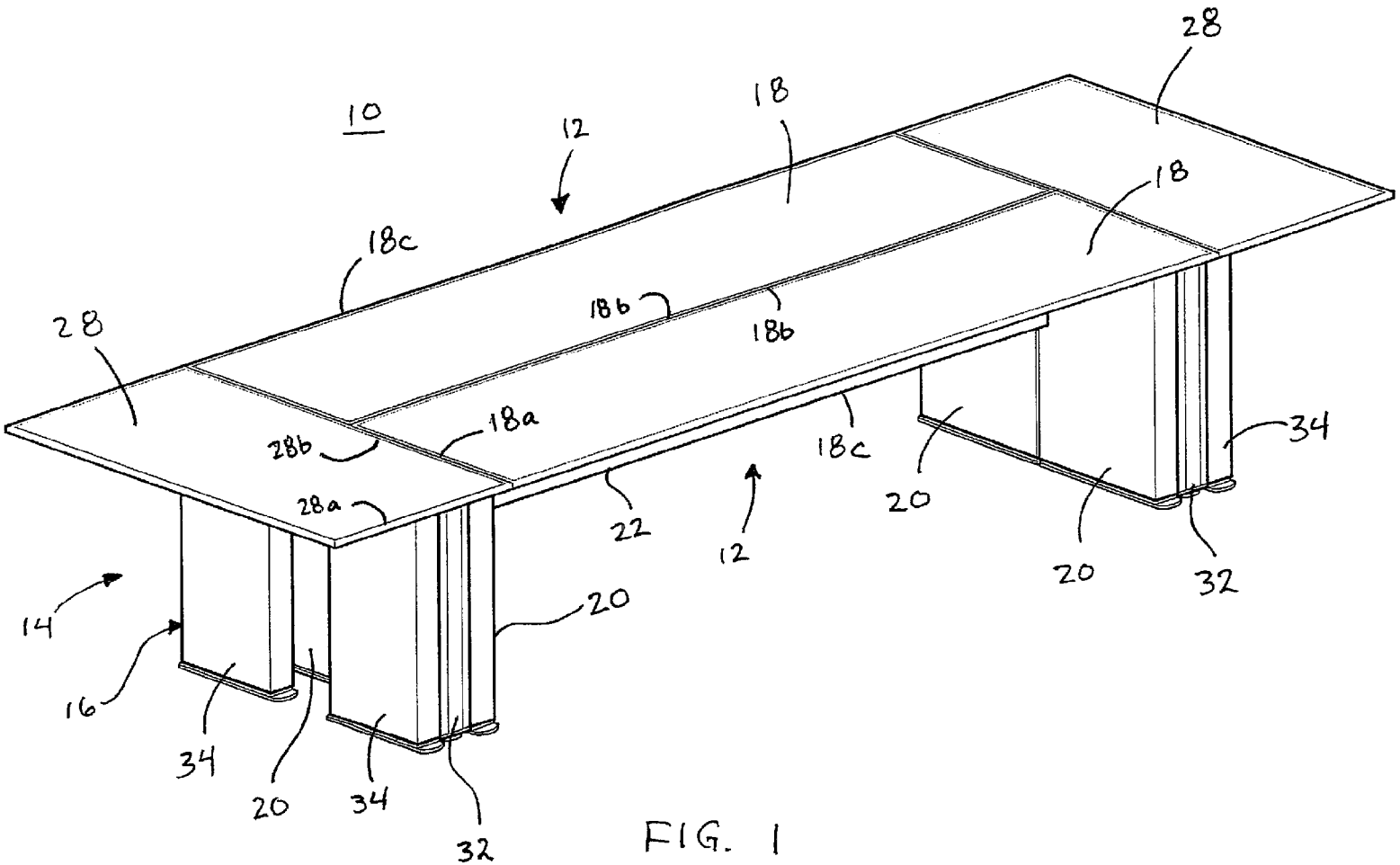
FIG. 1 is a perspective view of a modular conference table in accordance with the present invention.
Figure 2:
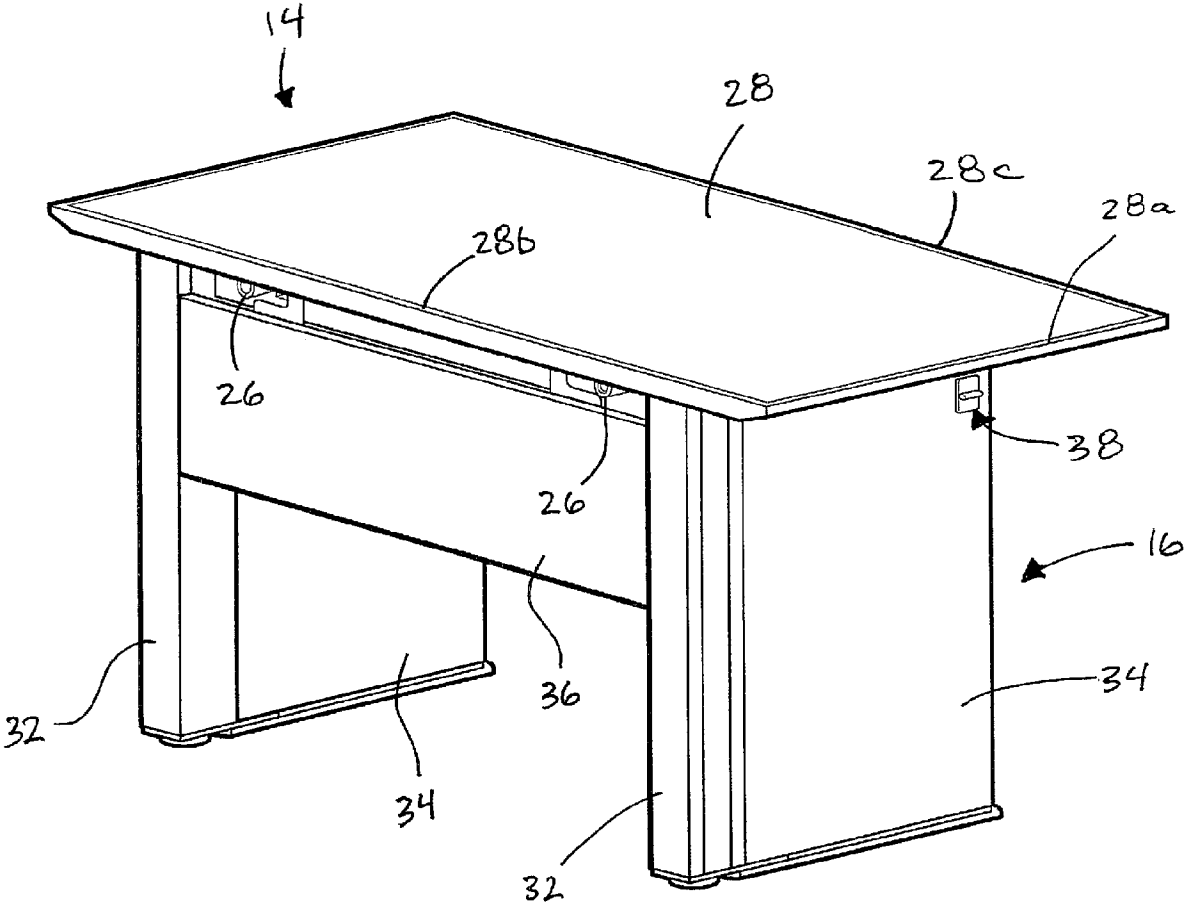
FIG. 2 is a perspective view of an end table or table section of the modular conference table of FIG. 1.
Figure 3:
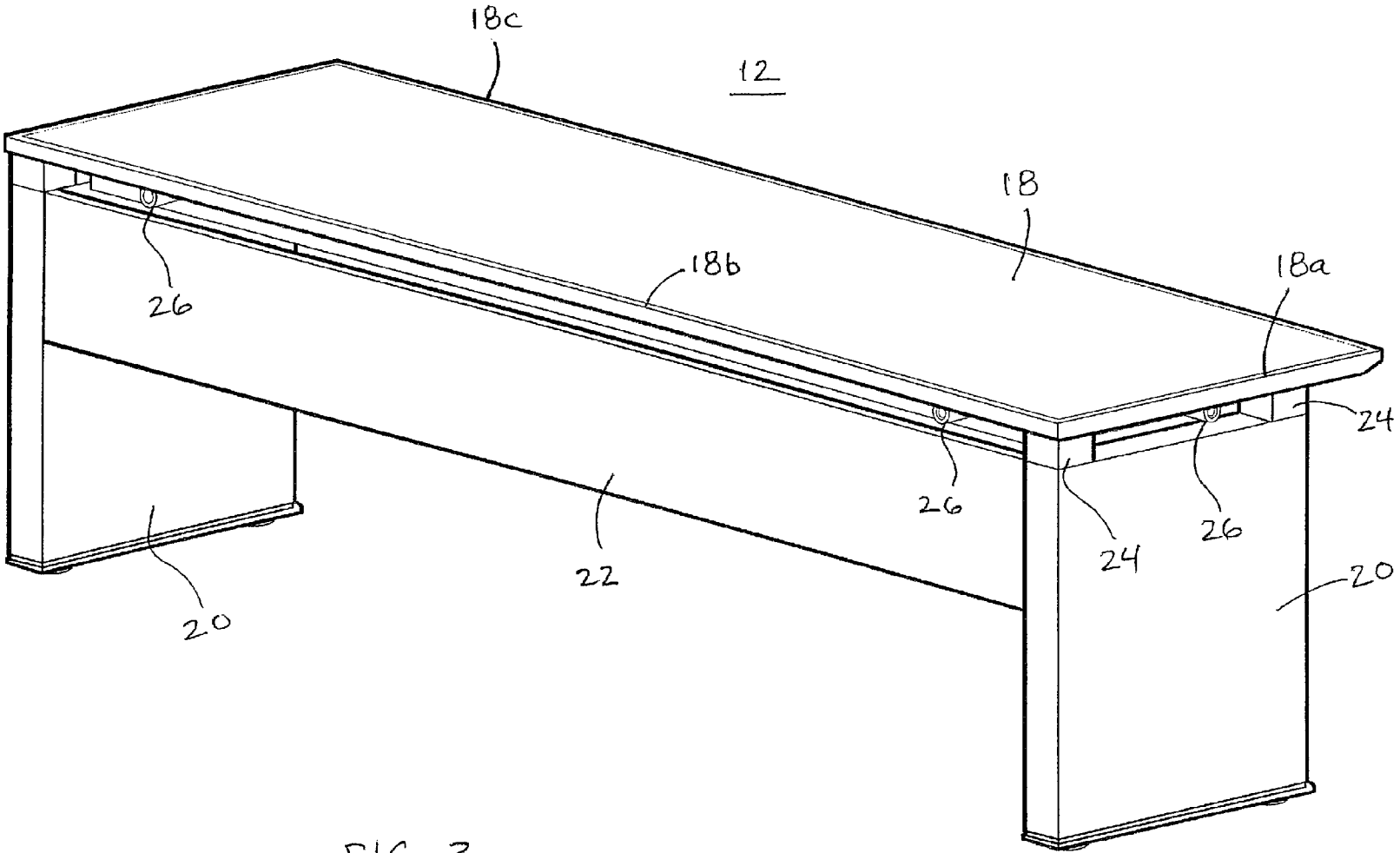
FIG. 3 is a perspective view of a side or elongated table or table section of the modular conference table of FIG. 1.
Figure 4:
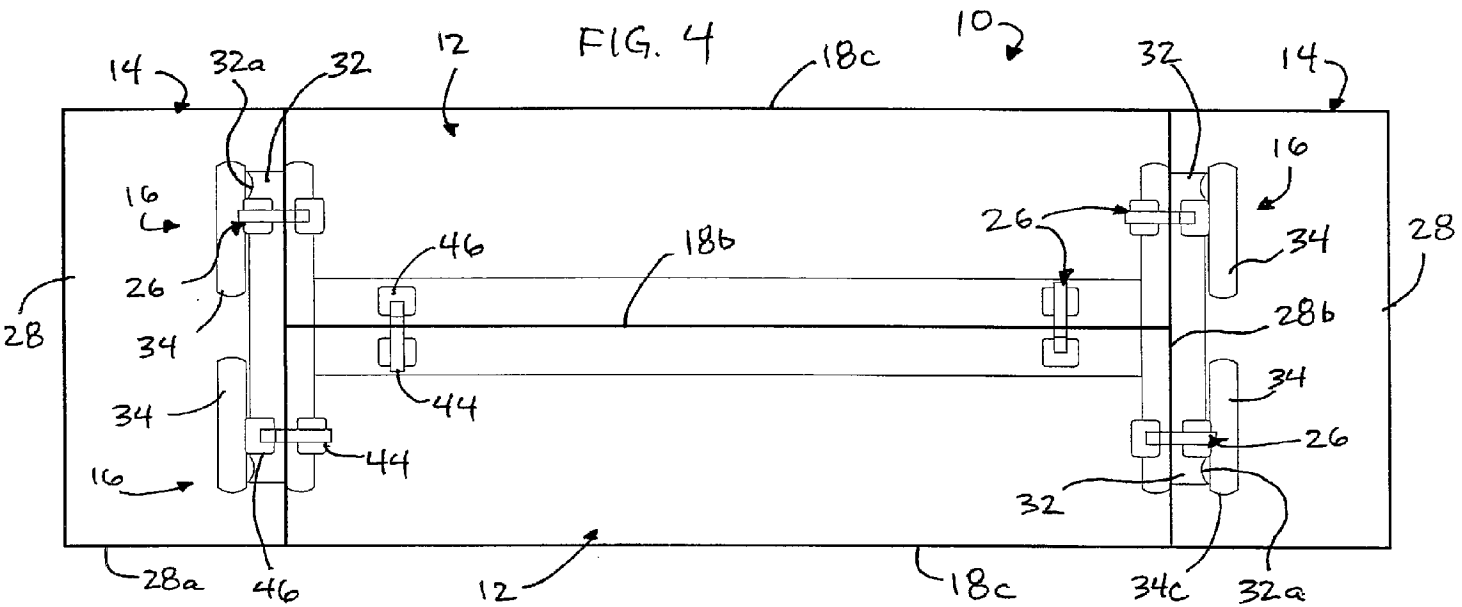
FIG. 4 is a top plan view of the modular conference table of FIG. 1, showing details of the support legs and securing elements through the table tops of the table sections.
Figure 5:
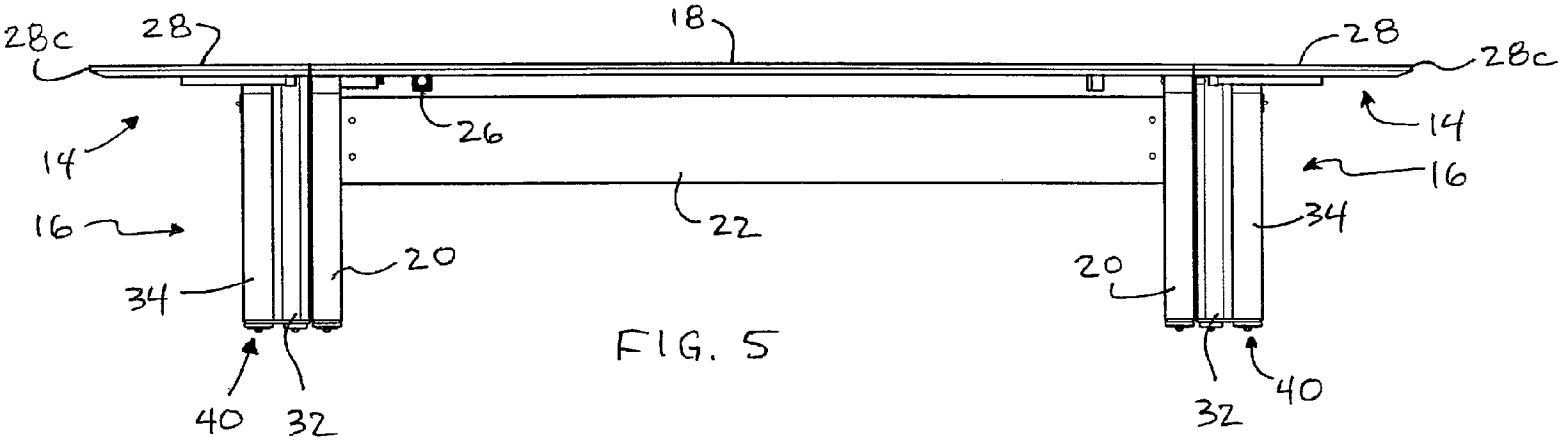
FIG. 5 is a side elevation of the modular conference table of FIGS. 1 and 4.

Referring now to the drawings and the illustrative embodiments depicted therein, a modular table or table assembly 10, such as for a conference table or the like, is made up of a plurality of individual tables or table sections or units, such as, for example, a pair of elongated first or side tables or table sections 12 and opposite end or second tables or table sections 14 (FIGS. 1-5). As shown in FIG. 1, the table sections may be abutted against one another and joined together to cooperate to define a conference table, as discussed below. When an end table section 14 is joined to the end or ends of one or more side tables or table sections (or optionally to another end table section), the support leg or legs 16 of end table section 14 can be moved or adjusted or pivoted from a free standing or supporting orientation (such as shown in FIG. 2) to a folded or non-supporting orientation (such as shown in FIGS. 1, 4 and 5), as also discussed below. When configured in the folded orientation, the support legs of the end table are generally adjacent to and aligned with the support legs 20 of the side tables 12 so that end table 14 appears to be an extension of the side tables 12 (with the end table top extending from and being generally coplanar with and flush against the side table tops with no vertical support at the outer end or side regions of the end table top distal from the side tables) and the assembled conference table 10 appears to be of unitary construction with opposite support legs or support columns.

In the illustrated embodiment of FIG. 1, modular conference table 10 includes two elongated side tables 12 disposed adjacent one another and between opposite end tables 14. Each side table 12 includes a table top 18 and a pair of support legs or columns 20, with one leg support or column at each end of the table top 18, and with each table top 18 having a length dimension that is greater than its width dimension. As can be seen in FIG. 3, support leg or column 20 is generally at or near or generally flush with an end perimeter edge 18*a* of table top 18. When arranged in the manner shown in FIG. 1, the rearward or inward perimeter edges 18*b* of table tops 18 abut against one another to form the central portion of the conference table. Table top 18 desirably has substantially sharp or straight or 90 degree edges along its end perimeter regions or edges 18*a* and along its rear perimeter edge region or edge 18*b*, such that the table tops of adjacent tables may be drawn tightly together with little or no gap therebetween when the modular conference table is assembled to the desired configuration, as discussed below. Side table 12 also includes an elongated support element or cross member 22 that may be attached to the support legs 20 so as to extend along the length of the table top between support legs 20 to provide structural rigidity to side table 12.

As can be seen in FIGS. 3 and 5, support leg 20 of side table 12 comprises a support column or wall or panel or member that is mounted to an underside of table top 18 at or near the end perimeter edges 18*a* thereof. As can be seen with reference to FIG. 4, support legs 20 of side tables 12 may be located near or adjacent to or generally flush with the end perimeter edges 18*a* and the rear perimeter edge 18*b* of table top 18, and are set back from the outer or front perimeter edge 18*c* of table top 18. In the illustrated embodiment, each support leg 20 is mounted to the underside of the table top 18 via a pair of posts or spacers 24, which space an upper end 20*a* of the support leg 20 from the underside of the table top 18 to provide a gap or spacing for mounting or receiving a securing device or element 26 (discussed below). Likewise, cross-member 22 is attached to the support legs or panels or walls 20 and may be spaced from the underside of the table top 18 to provide a gap or spacing for one or more securing devices 26. Thus, the securing devices may be located at or substantially immediately beneath the underside of the table top to secure the table tops in an abutting relation or orientation. The securing devices 26 are thus actuatable to secure the side table relative to an adjacent or abutted side table or end table and to substantially retain the adjacent tables and table tops in the joined arrangement, as discussed below.

End table 14 includes a table top 28 and a pair of support legs or panels or columns or walls or members 16 attached at an underside of table top 28. In the illustrated embodiment, table top 28 has a length dimension that is greater than its width dimension, and in the exemplary embodiment, has a length dimension that is about twice its width dimension. The table top 28 may be sized or selected such that its length dimension is also about twice the width dimension of the table top 18 of side table 12, such that, when the modular table 10 is assembled as a conference table (as shown in FIG. 1), the end table top 28 aligns with the table tops 18 of the two adjoined side tables 12 with its end perimeter edges 28*a* substantially aligned or flush with the forward perimeter edges 18*c* of table tops 18 of the side tables 12.

Figure 6:
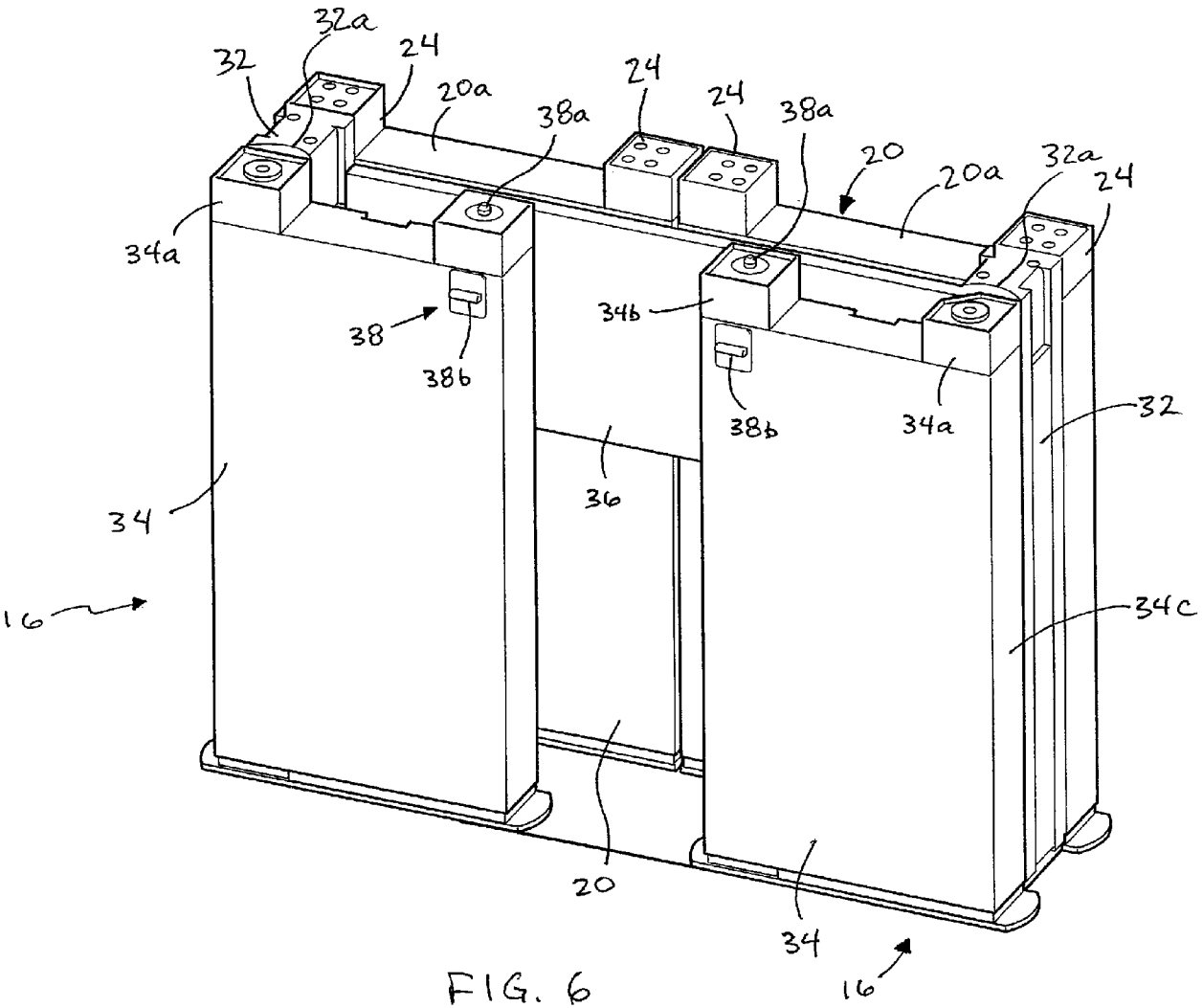
FIG. 6 is a perspective view of the support legs of the modular conference table of FIGS. 1, 4 and 5, shown with the table tops removed to show additional details.

As can be seen in FIG. 2, the support legs 16 of end tables 14 are inset from the end perimeter edge regions 28*a* and outer or front perimeter edge region 28*c* of table top 28, and are generally at or near or generally flush with a rear perimeter edge region 28*b* of table top 28. In the illustrated embodiment, the support legs 16 of end table 14 comprise a fixed post portion 32 that is substantially fixedly mounted at the underside of table top 28, and a pivotable support wall or panel or member 34 that is pivotally mounted at the underside of table top 28 and that is pivotable about a generally vertical pivot axis relative to table top 28 and relative to post portion 32. As shown in FIG. 6, pivotable support member 34 is mounted to table top 28 via a post or extension or spacer 34*a* at an upper end of the support leg or panel so that the upper end region of the panel or leg is spaced from the underside of the table top to provide a space or gap for the securing device 26. A second post or extension or spacer 34*b* is provided at the opposite or distal end of the support leg or panel from the fixed post portion to provide a locking element for selectively engaging the table top, thereby securing the pivotable support member at a desired or appropriate orientation relative to the table top.

Optionally, and as can be seen with reference to FIGS. 4 and 6, the fixed post portion 32 may have an arcuate or curved recess or groove 32*a* therealong for pivotally receiving a correspondingly curved or arcuate or rounded edge region 34*c* of pivotable support 34 as the support 34 is pivoted about its generally vertical pivot axis relative to post portion 32 and table top 28.

End table 14 also includes a horizontal member or cross member or longitudinal support 36 that is attached to post members 32 and extends therebetween to provide structural rigidity to the support legs 16 of end table 14. As can be seen in FIG. 2, cross member 36 is spaced downwardly from the underside of table top 28, so as to provide a gap or space or room for one or more securing elements or devices or components 26 for securing end table 14 to one or more side tables 12 or another end table 14, as discussed below.

As can also be seen with reference to FIGS. 2 and 6, pivotable support panel 34 may also include a locking or latching or retaining mechanism 38 (such as at or near extension 34*b*) for substantially retaining the pivotable support panel or leg 34 at either or any of the pivoted orientations relative to the support posts 32 and table top 28 of end table 14. In the illustrated embodiment, the retaining mechanism 38 comprises a locking pin or retaining pin or protrusion 38*a* that extends upwardly from extension 34*b* of pivotable support leg 34 and is remote from or spaced from the vertical pivot axis, whereby the pin 38*a* is upwardly movable to engage or to be received in a corresponding retaining cavity or element (not shown) at the underside of table top 28, such that the pivotable support leg 34 is substantially secured in a desired orientation relative to table top 28 via the retaining pin 38*a*. When it is desired to pivot the pivotable support panel or leg 34, a release element 38*b* may be grasped by the user and moved to disengage retaining pin 38*a* from the retaining element or recess or cavity at the underside of table top 28 to allow for pivotal movement of the pivotable support leg 34 about its vertical pivot axis and relative to the fixed post portion 32 and the table top 28. Optionally, the retaining pin 38*a* may be spring-loaded or biased upward, such that, upon release of the releasing element 38*b*, the pin is urged upward so as to engage an adjacent retaining element or recess at the table top 28 when the retaining pin 38*a* becomes substantially aligned with the element or recess or cavity. Although the illustrated embodiment includes a pin received in a cavity for retaining the support panel, it will be apparent to the skilled artisan that other retaining means may be used, such as cooperating structures using detents, friction, magnetic force or the like, to retain the pivotable support leg relative to the table top, without departing from the spirit and scope of the present invention.

Thus, the pivotable support legs 34 of end table 14 may be pivoted about their respective generally vertical pivot axes between an open or free standing support orientation (FIG. 2) and a folded or non-free standing support orientation (FIGS. 1 and 4-6). In the open orientation, the pivotable support legs are generally transverse to the longitudinal axis or length dimension of the table top 28 of end table 14 so as to provide free standing or firm support of the table top for use as an individual separate table that is separate from the other tables or table sections of the modular table. In the folded or non-free-standing support orientation (FIGS. 1 and 4-6), the pivotable support legs 34 are moved or pivoted so as to tenuously support or not support the table top in a free standing manner. For example, when in the non-free-standing orientation, the support legs may be moved or pivoted so as to be generally along the length dimension or longitudinal axis of table top 28 and generally along the rear perimeter edge region of 28*b* of table top 28 and generally along the cross member 36 and/or generally not supporting the outer or front perimeter edge region 28*c* of the table top 28.

Although shown and described as having a fixed post portion 32 and a pivotable leg portion 34, the support legs 16 of the end table 14 may have only the movable or adjustable or pivotable leg portions or panels, or the leg portions or panels may be otherwise adjustable between the free-standing orientation and the folded-in or retracted orientation, while remaining within the spirit and scope of the present invention. Also, although shown and described as having a pivotable leg portion that pivots about a generally vertical pivot axis, it is envisioned that an adjustable or pivotable leg portion of the end table may be pivotable or adjustable about a generally horizontal pivot axis and may pivot to be generally along and adjacent to the underside of the table top when in its folded position (and thus when the end table top is secured relative to the side table top or tops) so as to move the pivotable leg support or portion out of the seating area so that the end table top extends in a cantilevered manner from the side table or tables, while remaining within the spirit and scope of the present invention. In such an application, the fixed post portion of the support legs of the end table may comprise elongated support posts or panels so as to generally correspond to the fixed support legs of the adjacent side table so as to provide a unitary construction appearance to the end support columns of the assembled conference table. Other means of moving or adjusting or pivoting the support legs of a table section so that the table top is partially supported or secured relative to an adjacent table or table section (and so as to provide a table top overhang at an end of the modular table assembly with little or no interference at the seating area along and underneath the table top) may be implemented while remaining within the spirit and scope of the present invention.

Figure 7:
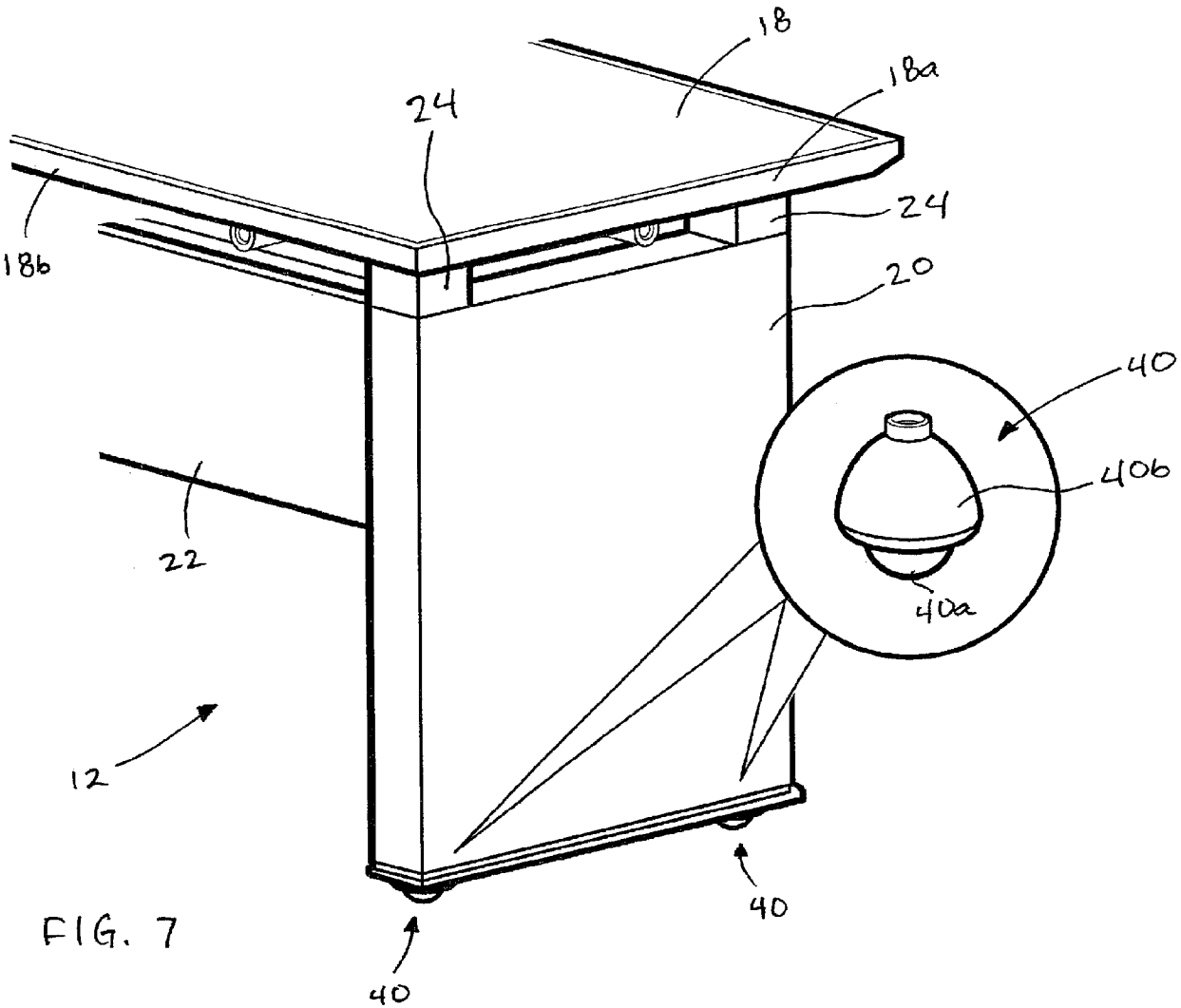
FIG. 7 is a perspective view of the support leg of the side table or table section, showing the ball casters at the lower ends of the support legs of the table or table sections.

Optionally, and desirably, and with reference to FIG. 7, the support legs 20 and 16 of the tables or table sections include movable supports 40, such as rollers or ball casters or the like, disposed at the lower ends of the support legs to facilitate movement of the tables on or along a support surface or floor, in order to ease the movement or reconfiguration of the modular table to the desired arrangement or configuration. The movable supports or ball casters 40 may comprise any suitable type of caster or the like for providing rolling movement of the tables along the support surface, and may have a roller or ball 40*a* (such as a metal or plastic ball or a ball of any other suitable material) rotatably housed at least partially within a housing or socket or mounting portion 40*b*, which is at least partially recessed into the lower portions of the support legs, such that only a portion of the roller or ball 40*a* protrudes downwardly from the lower ends of the support legs. The ball casters thus are not readily viewable to a person viewing the conference table, yet may substantially ease the movement and assembly of the conference table. Optionally, the movable supports may comprise a wheel or other rollable or movable support means. Also, the movable supports may be releasably lockable, so that the table is not readily movable over the support surface or floor when the ball or wheel or the like is locked. The movable supports or ball casters may be mounted or attached to the legs of the tables during manufacture of the tables, or the movable supports or ball casters may be provided for installation at the table installation site or facility or conference room, where the movable supports may be optionally installed to the table during the set up of the table or table units.

Figures 8A, 8B, 8C:
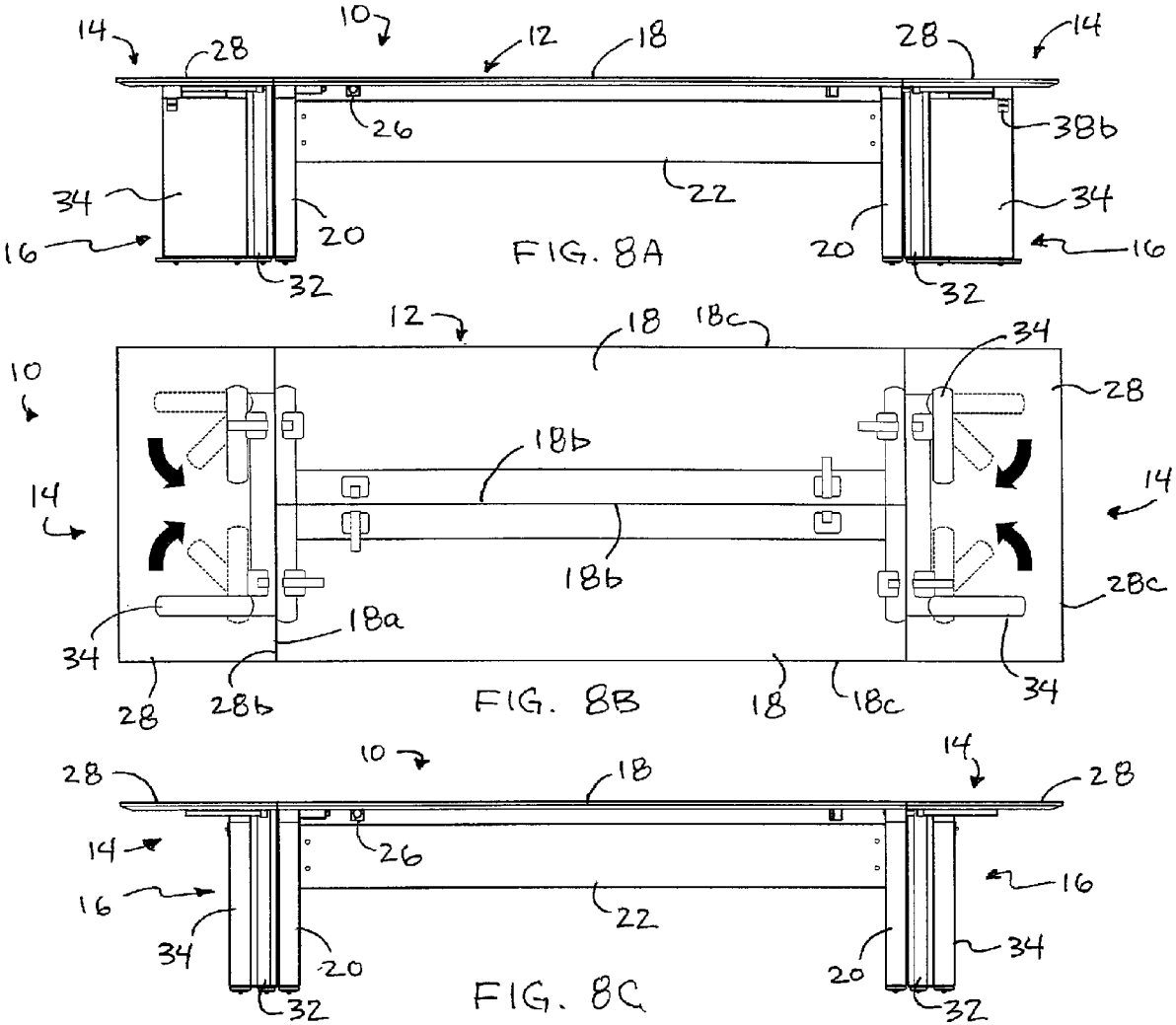
FIGS. 8A-C are side elevations and a plan view of the modular conference table, showing how the support legs of the end tables are moved or pivoted between their free standing support orientation and their conference table support orientation.

Thus, and with reference to FIGS. 8A-C, two elongated side tables 12 may be arranged side by side one another and with their longitudinal axes generally parallel to one another. The rear edges 18*b* of the table tops 18 of the side tables 12 may abut against each other, and the tables may be secured together via the securing device 26 (discussed in detail below). An end table 14 may be positioned at the ends of the joined side tables 12, with the rear perimeter edge 28*b* of table top 28 of end table 14 abutting the adjacent and aligned side perimeter edges 18*a* of table tops 18 of side tables 12. The end table 14 may be secured to the end regions of each of the elongated side tables 12 via respective securing devices 26. The components of the securing devices (discussed below) are mounted at each table or table section such that when the components are aligned and engaged, the table tops of the adjacent or adjoining tables or table sections are aligned along their outer side or end edges to form a substantially uniform or unitary modular table construction or assembly. The securing devices 26 function to substantially secure or fix the upper portion or region of the end tables 14 to the upper portions or regions of the ends of the side tables 12, such that the rear edge 28*b* of table top 28 of end table 14 is held tightly against the end edges 18*a* of table tops 18 of side tables 12.

When so secured, the pivotable support legs 34 of end table 14 may be pivoted about their generally vertical pivot axes (as shown in FIG. 8B) so as to be oriented generally along the longitudinal axis of the end table (and along the cross member 36 and rear perimeter edge 28*b* of table top 28) and generally along the support legs 20 of the adjacent side tables 12. Thus, and as can be seen in FIGS. 1 and 8C, the support legs 20 and 16 (when the pivotable support legs 34 are pivoted inward) cooperate to form a single support column or structure at or near each end of the assembled conference table 10. When so oriented, the support legs 16 will no longer vertically support the outer or front end region 28*c* of the table top 28 and thus no longer support the end table 14 in a free-standing manner (because the end table, if not secured to the side table or tables, would tilt or tip toward its outer or front perimeter region). The securement of the end table top 28 to the side table top or tops 18 secures the table tops 18, 28 in an aligned and substantially coplanar and flush arrangement and limits or substantially precludes tilting or tipping of the end table 14 when its legs 16 are folded or pivoted or moved so as to no longer vertically support the outer or forward portion of the table top, whereby the secured end table provides an overhang table top or table top extension at the end of the assembled conference table.

As can be seen in FIG. 4, the support legs 16 of end table 14 are inset from the end regions 28*a* of table top 28, while the support legs 20 of side table 12 are generally flush with the end regions 18*a* of table top 18 and set rearwardly or toward the rear end region 18*b* of table top 18. Thus, when the end table is positioned adjacent to the end of the side table, the support legs 16 of end table 14 generally align with an outer end 20*a* of fixed support leg 20 of side table 12. When the pivotable support leg 34 is pivoted to its folded orientation, the pivotable support leg 34 is generally parallel to and aligned with the fixed support leg 20 so as to provide an aesthetically pleasing unitary construction appearance of the support columns and increase the available leg room at the ends of the conference table when the conference table is assembled. As can be seen in FIGS. 1 and 6, when the pivotable support legs 34 are pivoted to their folded-in orientation, a gap or space may be present between the pivotable support panels 34 and fixed support legs 20 (the gap being due to the presence of the posts 32 of the support legs 16 of end table 14). Such a gap or space may be used for routing electrical wiring or the like from a floor outlet or source to one or more ports or outlets or the like at one or more of the table tops of the conference table, as discussed below.

In order to limit or substantially preclude any substantial or noticeable tilting or tipping of the end table 14 when the support legs 34 are pivoted to their inward or folded orientation, the end table is first secured to the ends of the side tables at or near or immediately below the respective table tops so that the upper end or upper end portion of the end table is secured to the upper portion of the ends of the side tables. Thus, when the pivotable support legs 34 are pivoted to their folded orientation, the end table top is partially supported by the support legs 16 and secured to the side tables 12 to limit or substantially preclude tipping of the end table 14 and separation of the end table top 28 from the side table tops 18 when the end table legs 34 are folded and no longer in the free standing support orientation. The modular table of the present invention thus provides for a partially cantilevered support of the end table top (with the end table top being retained relative to the side table tops so as to provide a substantially planar and continuous conference table top) to provide an aesthetically pleasing conference table and further to move the support legs of the end table inward and out of the way so as to enhance the seating of people around the conference table.

In the illustrated embodiment, the securing device 26 comprises a ratcheting device with a ratchet element 44 mounted at an underside of one of the table tops and a receiving element or collar element 46 mounted at an underside of another one of the table tops. When the table tops are abutted together, the ratchet element 44 may be moved from a disengaged or retracted position to an engaged or extended position (where the ratchet element engages the collar element) to secure the tables together.

Figure 9:
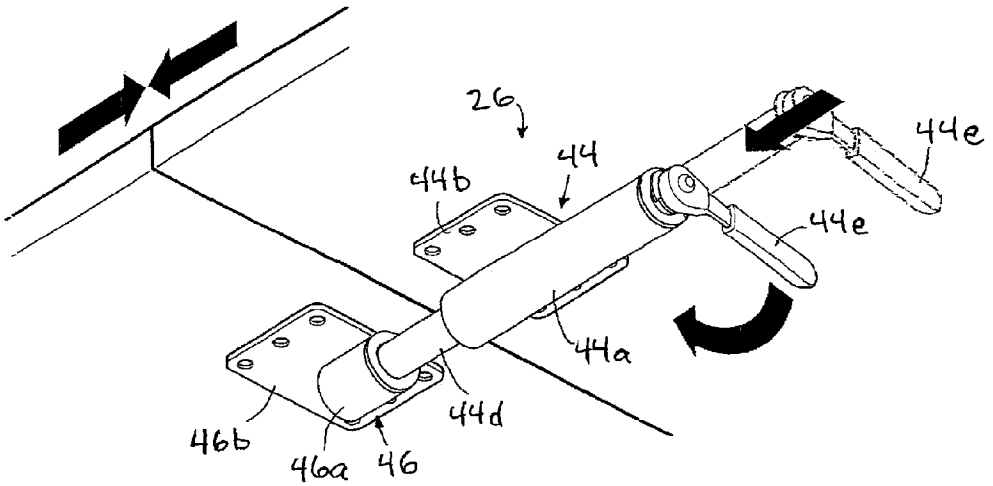
FIG. 9 is a perspective view of a securing device for securing the tables or tables or table sections together in accordance with the present invention.
Figure 12:
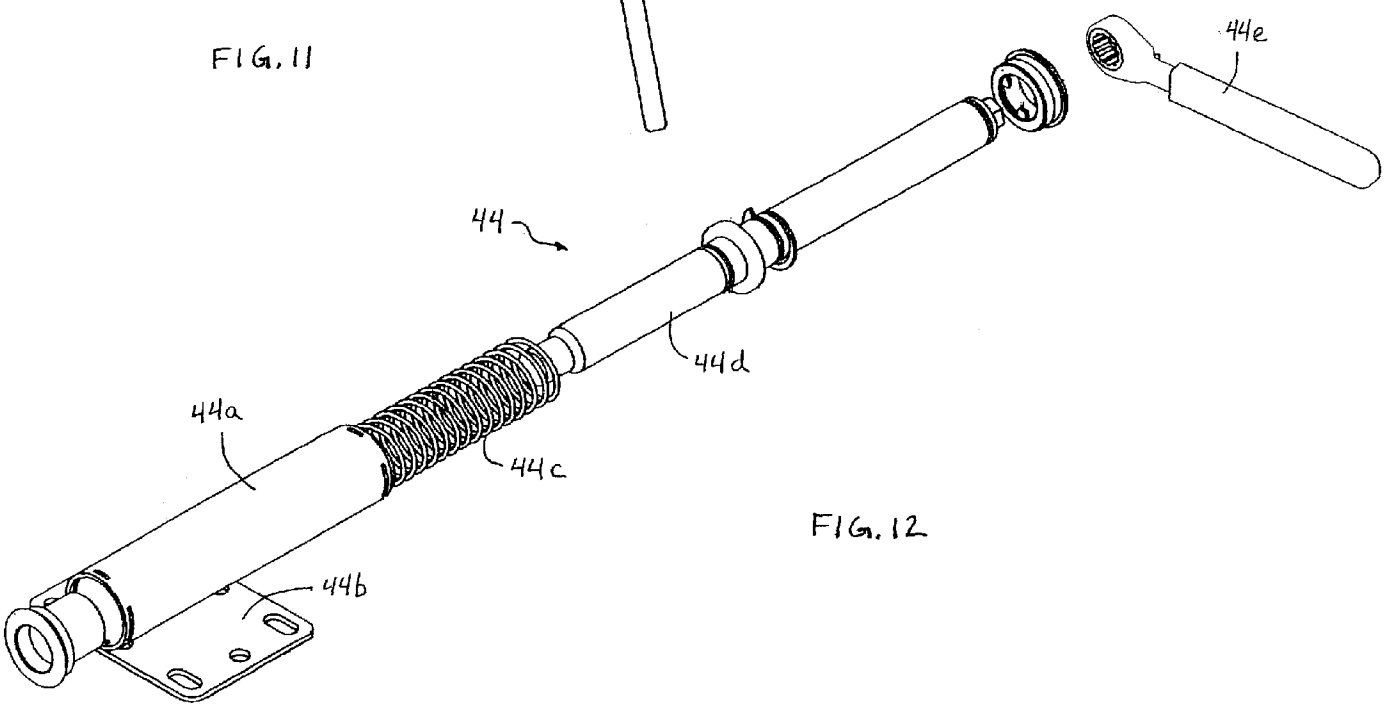
FIG. 12 is an exploded perspective view of the securing element of FIG. 11.

In the illustrated embodiment, and with reference to FIGS. 11, 12 and 16-18, ratchet element 44 comprises a mounting cylinder 44*a* affixed to a mounting bracket 44*b* for attaching the ratchet element 44 at one of the tables, such as to or at the underside of a respective table top. The housing 44*a* receives a spring or biasing element 44*c* and an elongated ganging member or element 44*d*, which may be urged against spring 44*c* (which biases or urges the ganging element toward its retracted or disengaged position, such as shown in phantom in FIG. 9) to extend from housing 44*a* and may be rotated to threadedly engage the collar element 46 at the other table or table top. As shown in FIG. 12, the elongated element 44*d* may have a fastener head or the like at an outer end thereof, whereby a ratchet handle 44*e* may be mounted to or secured to or temporarily positioned at the fastener and cranked or rotated to rotate the elongated member or shaft 44*d*.

Figure 13:
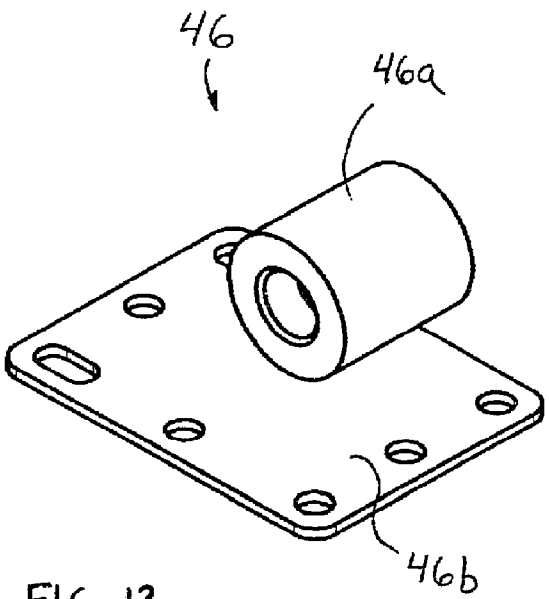
FIG. 13 is a perspective view of a receiving collar of the securing device of FIGS. 9 and 10.
Figure 14:
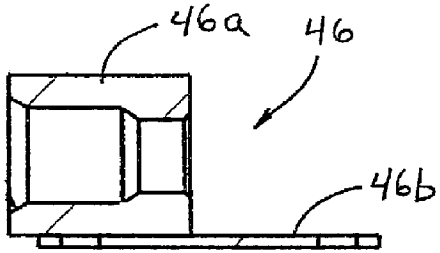
FIG. 14 is a sectional view of the receiving collar of FIG. 13.

As shown in FIGS. 13 and 14, the collar element 46 includes a receiving portion or collar portion 46*a* and a mounting bracket 46*b*. The collar portion 46*a* is at least partially threaded, so as to threadedly engage a threaded end of the elongated member or shaft 44*d*, such that rotation of the shaft 44*d* draws or urges the collar element 46 (and thus the table top that it is mounted at) toward the ratchet element 44 (and the table that it is mounted at) to substantially secure the adjacent table tops in a tightly abutted or joined configuration with little or no gap therebetween.

Figure 10:
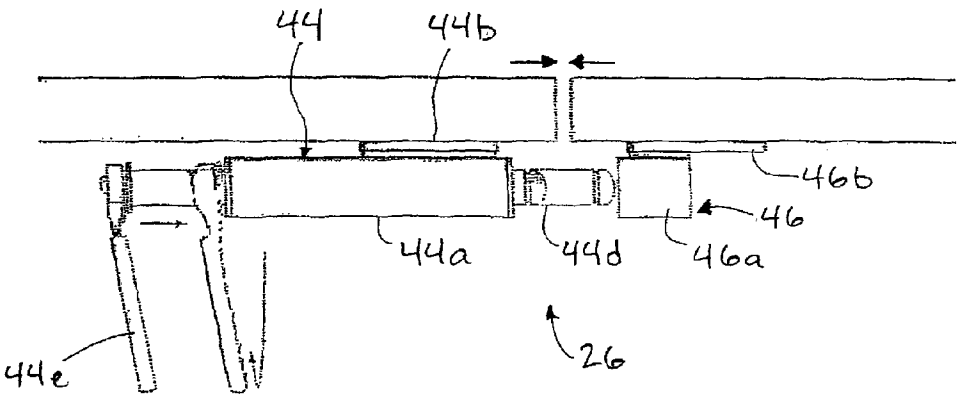
FIG. 10 is a side elevation of the securing device of FIG. 9.
Figure 11:
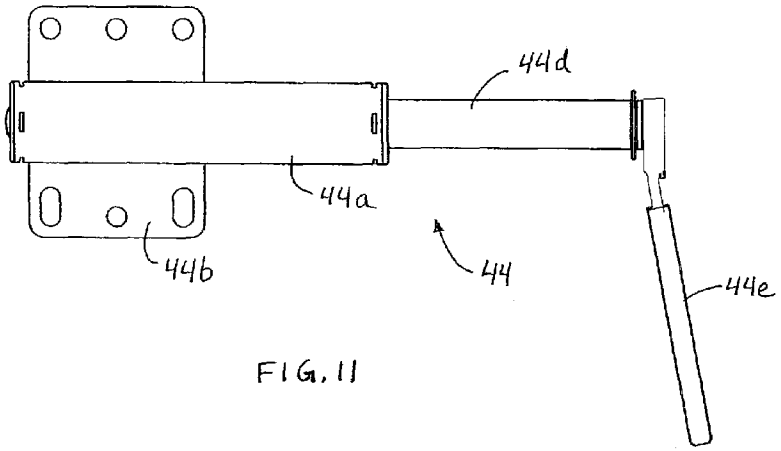
FIG. 11 is a plan view of an actuatable securing element of the securing device of FIGS. 9 and 10.

As can be seen in FIG. 10, when not in use, the ratchet element 44 may be moved to a retracted position, such that the end of the shaft 44*d* is inward from the respective edge of the table top so as to not protrude outward from the table top. When the table tops of two adjoining or adjacent tables are abutted against one another, the ratchet element may be moved to its extended position (such as via a user grasping the ratchet handle 44*e* and pushing or urging the handle against the spring forces), whereby the shaft protrudes beyond the edge of the table top (as can be seen in phantom in FIG. 10) so as to engage or be received in the collar portion 46*a* of collar element 46. When so extended, and when received in the collar portion 46*a*, the user may rotate or pivot the ratchet handle 44*e* to rotate shaft 44*d* to draw the table tops into tight abutment.

Figure 15:
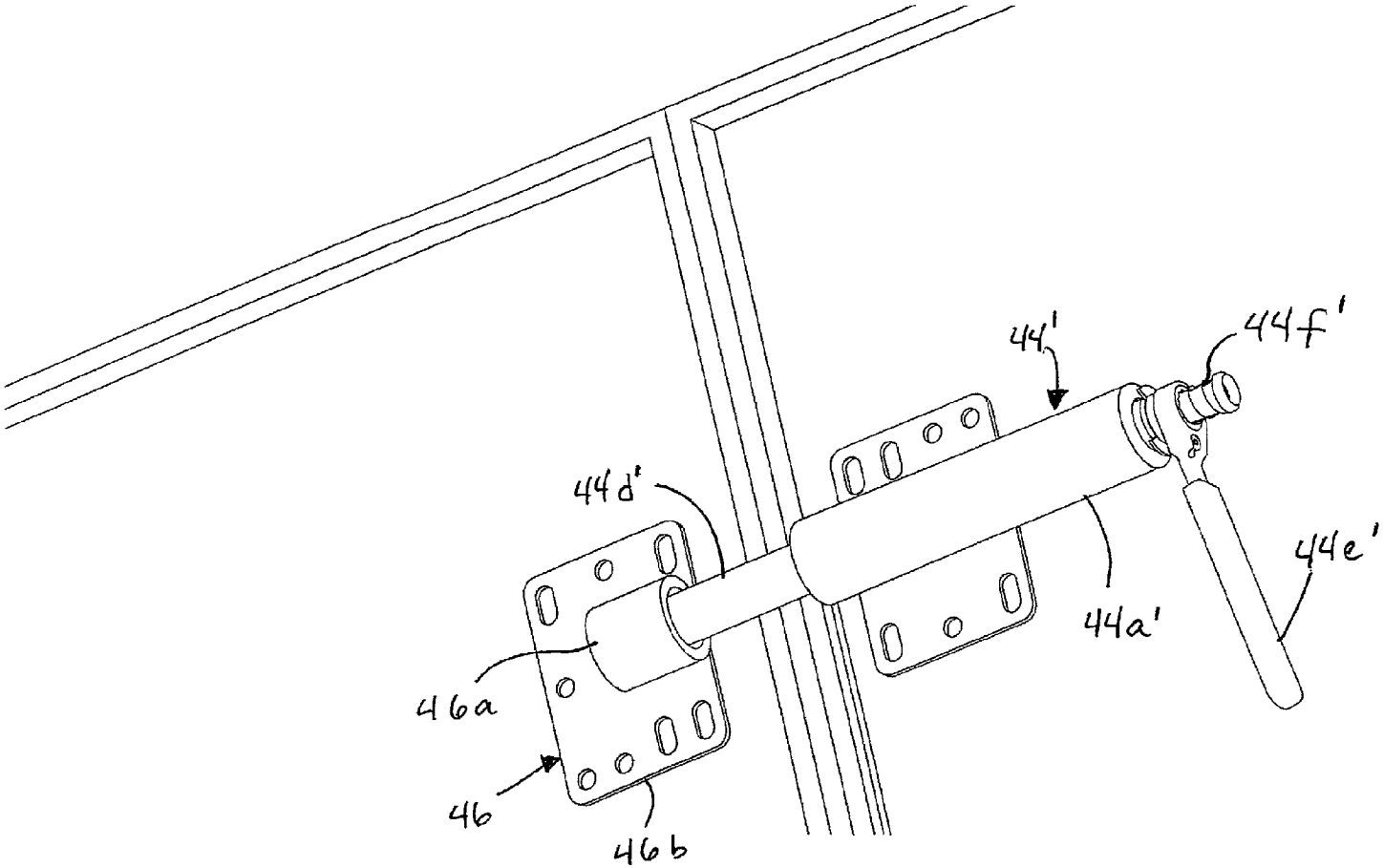
FIG. 15 is a perspective view of a securing device similar to the securing device of FIG. 9, shown with a disengagable handle.
Figure 16:
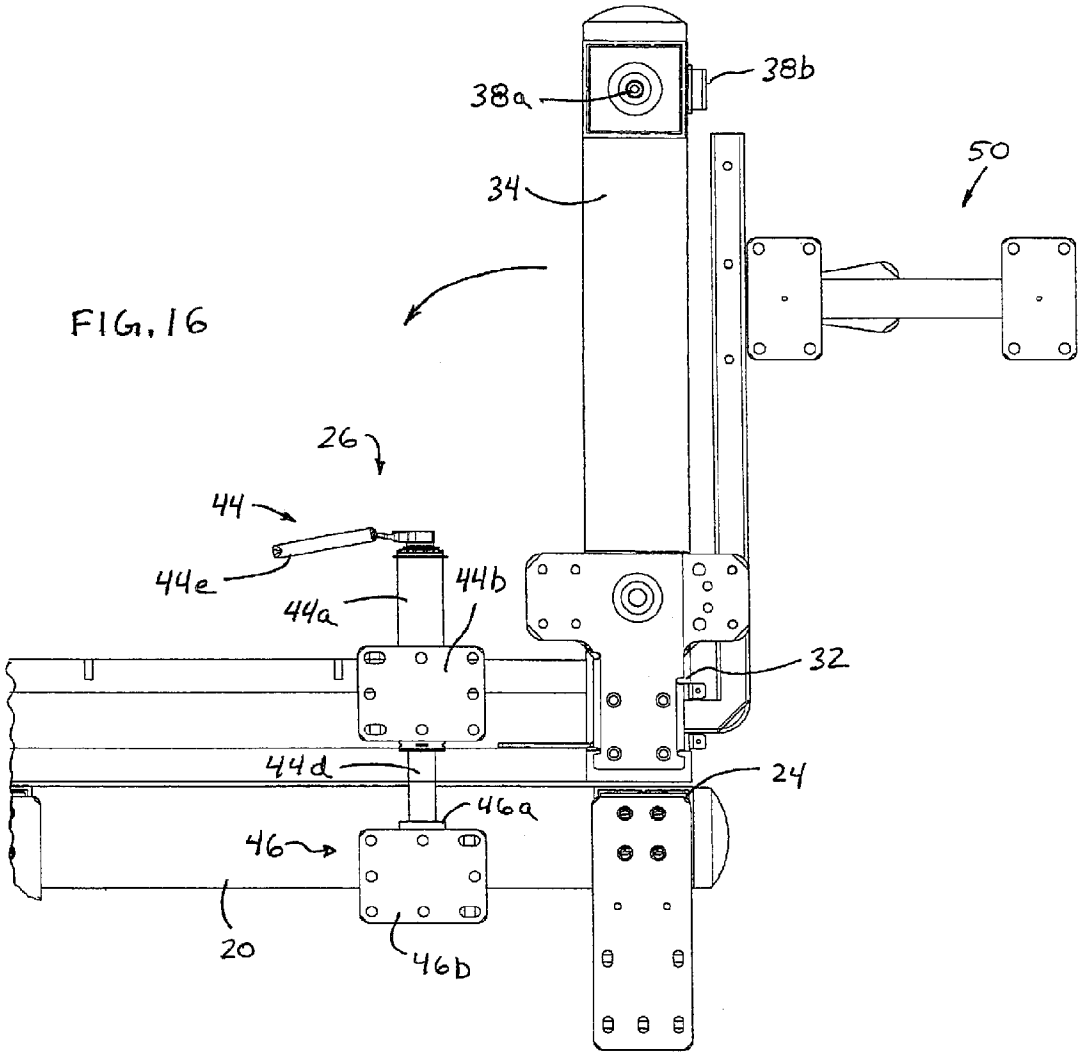
FIG. 16 is a top plan view of a portion of the modular conference table of the present invention, with the table tops removed to show additional details of the support legs and securing devices.
Figure 17:
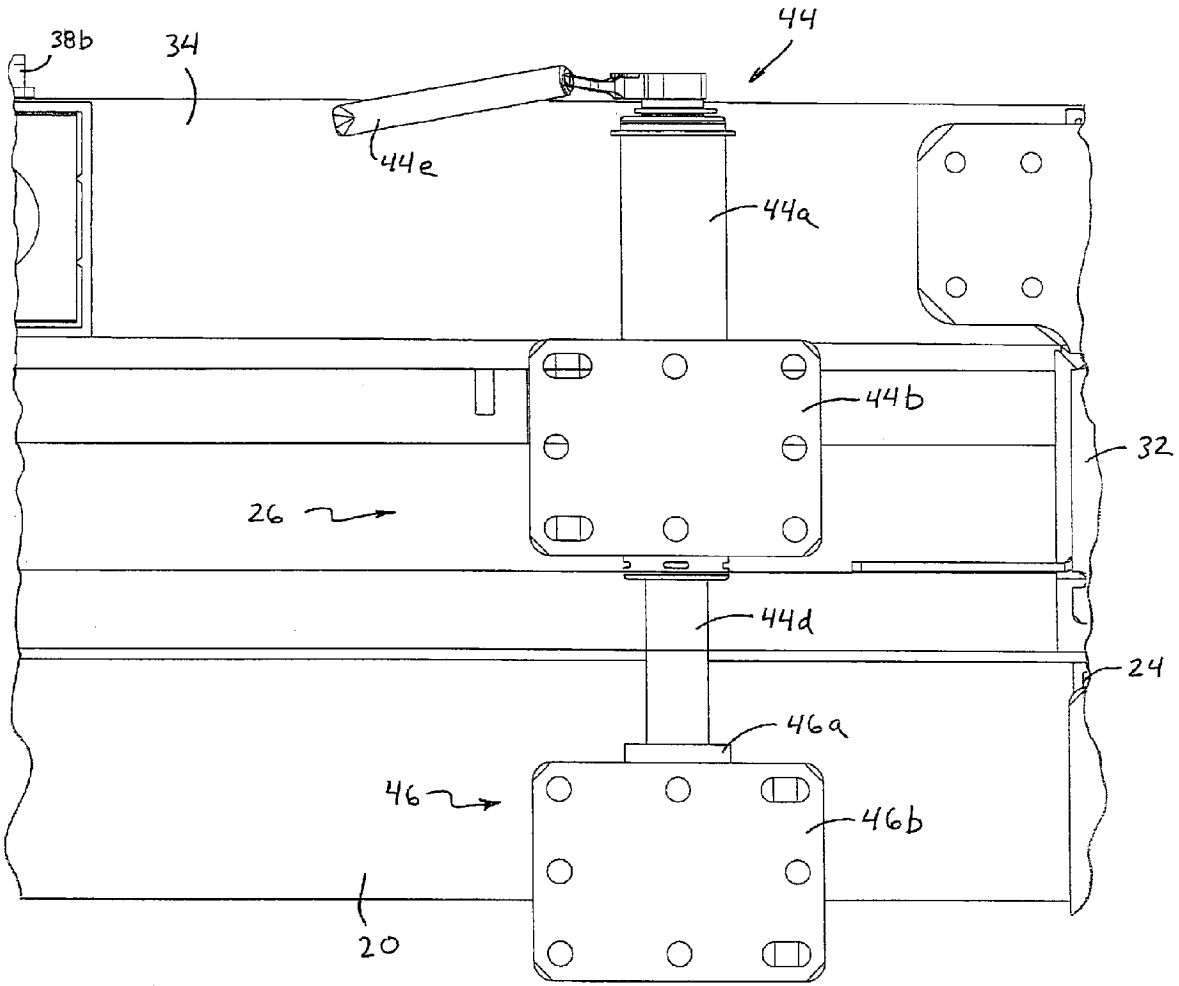
FIG. 17 is an enlarged top plan view of the securing device in FIG. 16 with the support leg of the end table or table section pivoted to its aligned orientation.
Figure 18:
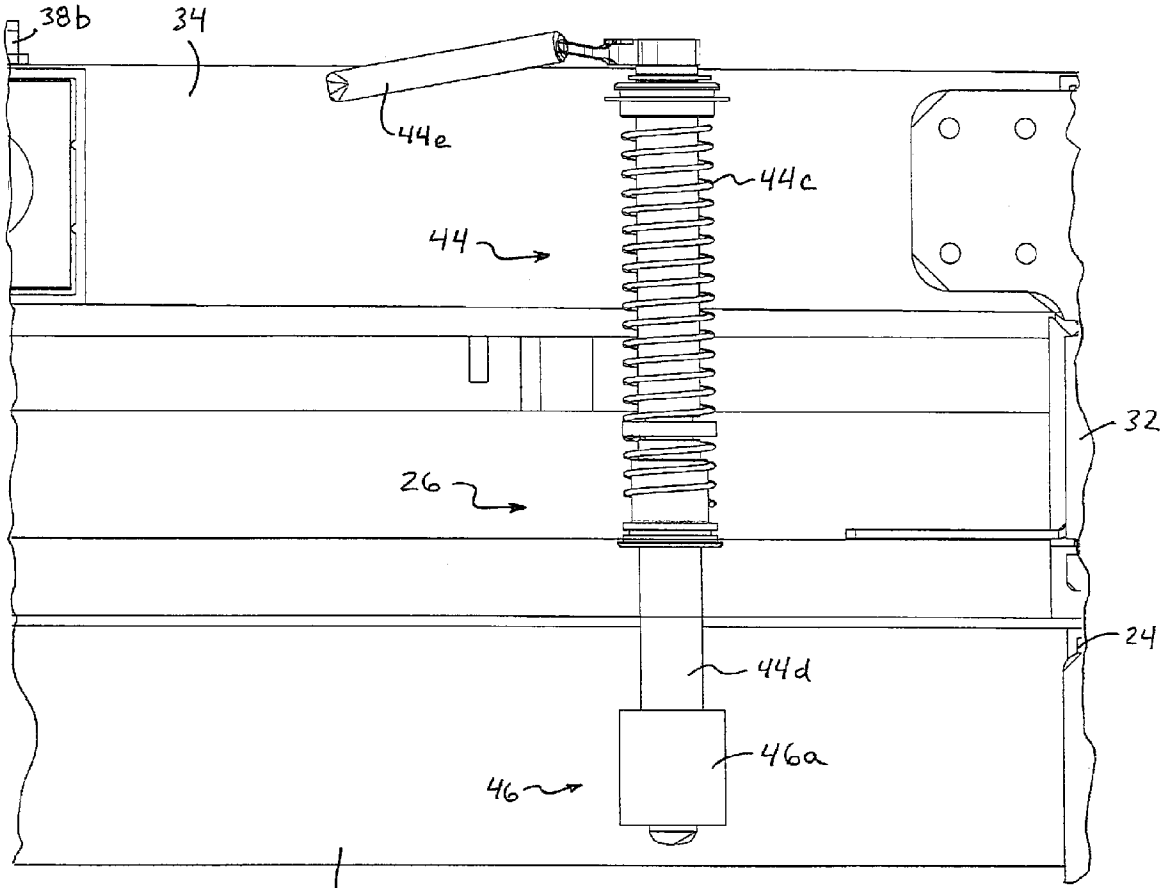
FIG. 18 is an enlarged plan view similar to FIG. 17, with portions of the securing device removed to show additional details.

Because of the limited clearance around the ratchet element 44, which is located substantially immediately beneath the table top, a foam pad or resilient element may be provided at the table top and generally at the ratchet handle 44*e* to ease the releasing of the ratchet (which typically requires slight rotation to allow the ratchet gears or teeth to disengage) by allowing for additional pivotal movement of the handle against the resilient pad, in order to ease the loosening and disassembling of the tables when it is desired to configure the modular table in a different manner. Optionally, and as shown in FIG. 15, a handle 44*e*' may be disengagable from an elongated member or shaft 44*d* by pulling handle 44*e*' away from mounting cylinder 44*a*', thereby disengaging the handle from the shaft 44*d*' (and disengaging handle 44*e*' from ratchet element 44') and allowing substantially free rotation of the handle away from the table top. When disengaged, the handle may be rotated away from the underside of the table, so as to provide ease of access to the handle and to allow the user to engage ratchet element 44' with handle 44*e*' when the handle is pivoted to a lowered or desired orientation. Optionally, handle 44*e* may be biased toward the mounting cylinder by a spring or biasing element 44*f*', so that the handle, after being disengaged, will spring or snap back into engagement with the ratchet element when released by the user. Thus, when the handle is against the underside of the table (and may be biased or held against the underside of the table by tension in the ratcheting mechanism), the handle can be pulled out against the spring bias, thereby disengaging the handle from the ratchet element, and freely pivoted away from the table. The handle may then be released so that the handle is again engaged with the ratchet element, so that the handle may be moved to release and/or reverse the ratchet setting (thereby relieving any stored tension in the ratcheting mechanism) to allow for movement of the handle and shaft in the other direction, in order to disassemble or break down the modular table into individual tables or table units.

When the securing devices have substantially tightened and secured the table tops together, the pivotable support leg or legs of the end table or tables may be pivoted to their folded-in orientation. Optionally, a safety element or locking element or movement limiting element may be provided to limit pivotal movement of the pivotable support leg until the securing device is moved to its in use position and has substantially tightened the table tops together. For example, a locking tab or element may be provided at or near the ratchet handle, whereby the tab engages the pivotable support leg to limit or substantially preclude pivotal movement of the support leg until the ratchet element 44 is moved into its engaging and tightening orientation, whereby the tab may be moved or disengaged from the support leg to allow for pivotal movement of the pivotable support leg toward its folded-in orientation.

Optionally, the ratchet element or device itself may function to limit pivotal movement of the pivotable support leg until the ratchet element is moved to its extended or use position by a user. For example, the ratchet device, when in its non-use position, may interfere with the pivotal movement of the support leg so as to limit or substantially preclude pivoting of the support legs until after the table is secured to another table via the ratchet device. When the ratchet element is moved or pushed to its extended or securing position and retained in the securing position via engagement with the collar at the adjacent table, the ratchet handle is moved and retained out of the way of the pivotable support leg to allow for pivotal movement of the support leg to its non-support orientation. Optionally, and desirably, a retaining element, such as a magnet or the like, may be provided at the underside of the table top to retain the ratchet handle in an "up" orientation and substantially along the table top, such that the ratchet handle does not hang downward from the table top when not in use.

In the illustrated embodiment of FIGS. 4 and 8B, the end tables 14 have two securing devices 26, one for securing the end table to an end of one of the side tables and the other for securing the end table to the other of the side tables. In the illustrated embodiment, the securing devices are reversed, such that at one side of the end table, a ratchet element 44 is mounted for connecting to a collar element 46 at the end of the adjacent side table, while at the other side of the end table, a collar element 46 is mounted for receiving or engaging the shaft of a ratchet element 44 mounted at the end of the adjacent side table. Likewise, each side table has an alternating configuration of securing devices for securing the rear edges 18*b* of the side table tops 18 together. By providing alternating configurations of the securing devices at the end tables and side tables, the modular table may be arranged in many different configurations, with the side tables and/or end tables connected together via the corresponding or aligning securing devices.

Figure 19:
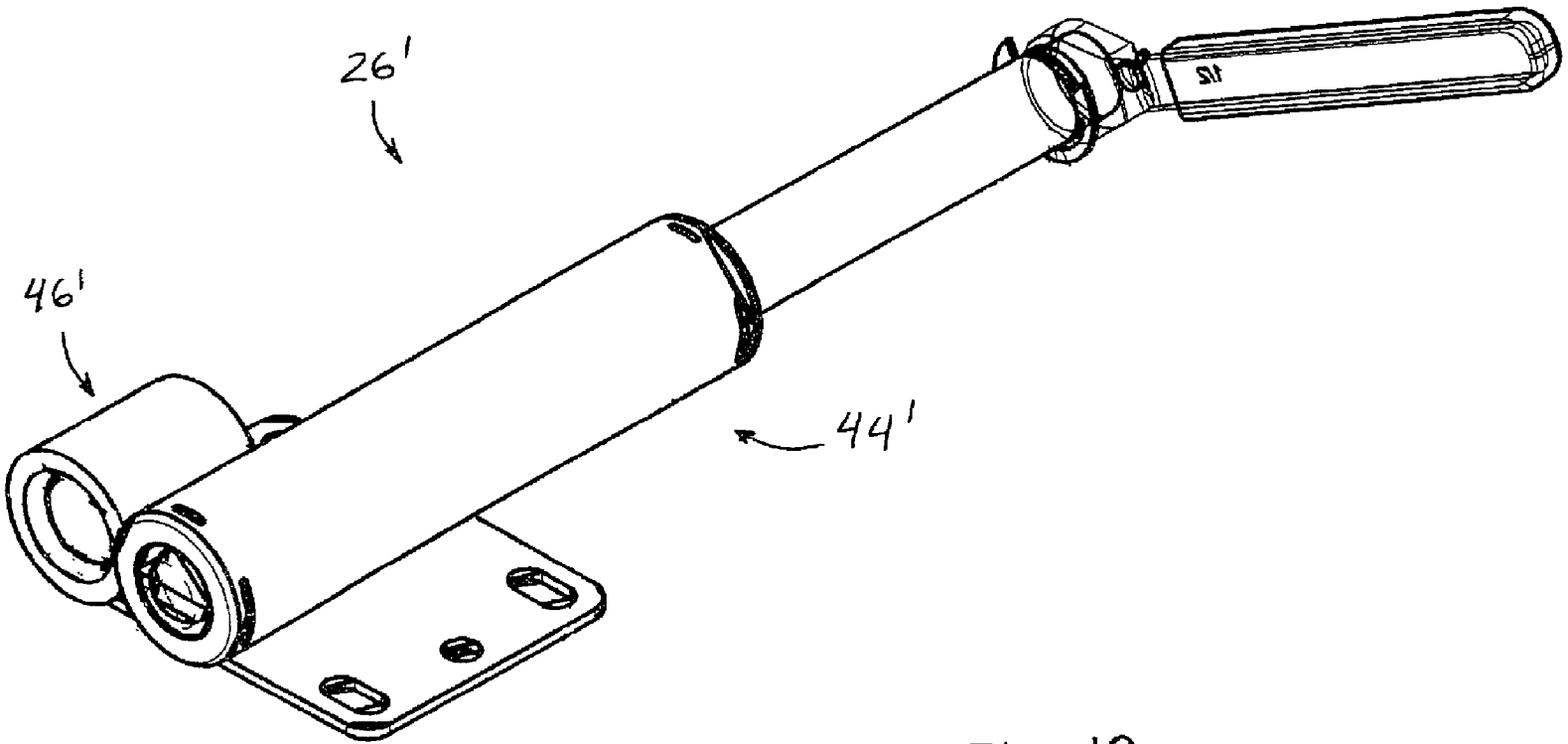
FIG. 19 is a perspective view of another securing device suitable for use with the modular table of the present invention.
Figure 20:
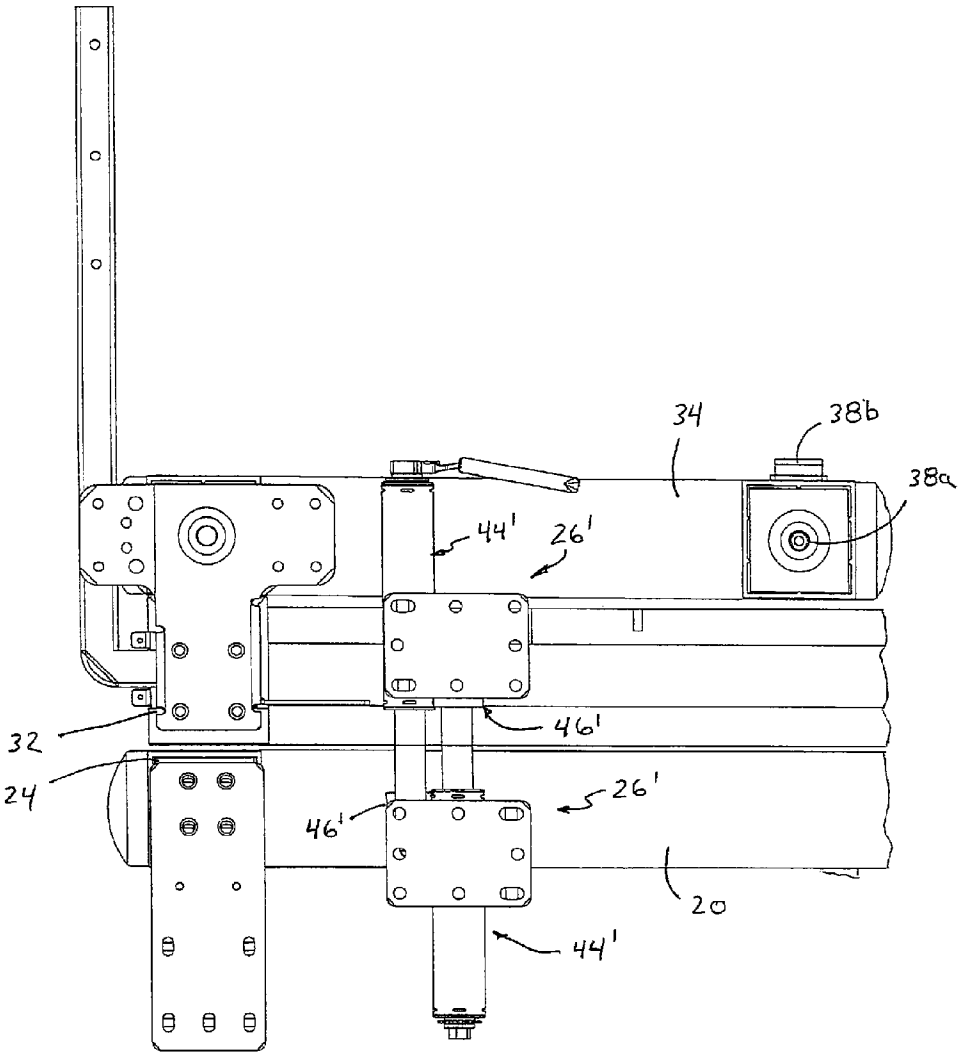
FIG. 20 is a top plan view of a portion of the modular table having the securing device of FIG. 18, with the table tops removed therefrom to show additional details.
Figure 21:
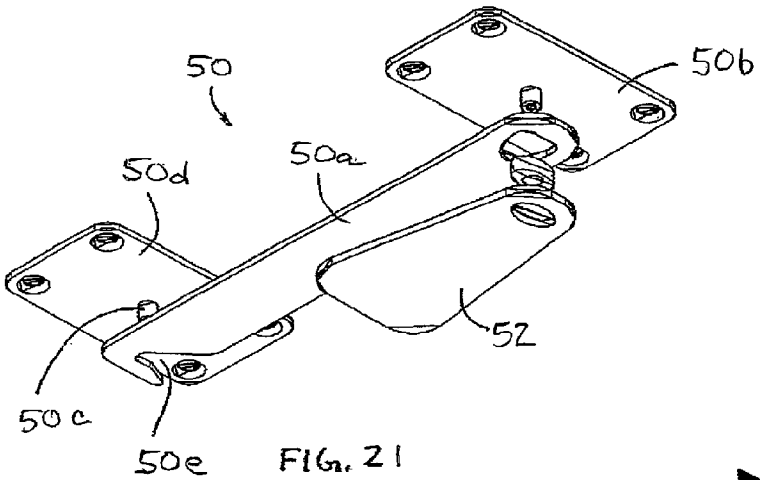
FIG. 21 is an exploded perspective view of a second securing element or latch element for securing and retaining the table tops together when the modular table is assembled in accordance with the present invention.
Figure 22:
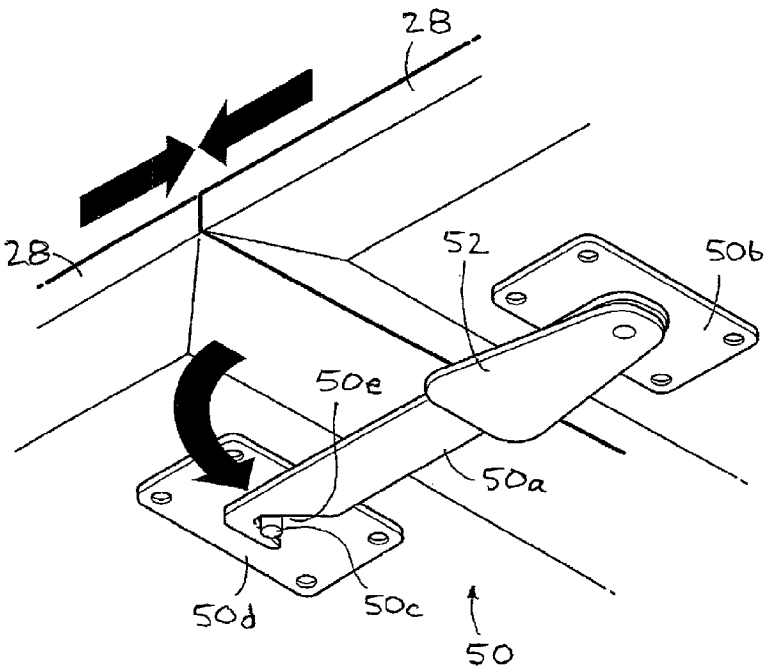
FIG. 22 is a perspective view of the latch element of FIG. 21, shown mounted to the underside of the table tops of the modular table.

Optionally, and as shown in FIGS. 19 and 20, each securing device 26' of each table may have both securing elements, namely, a collar element 46' and a ratchet element 44', whereby a dual connection may be made between the adjoined or abutted tables to enhance the securement of the tables relative to one another. The ratchet element and collar element may be substantially similar to the ratchet element 44 and collar element 46, discussed above, such that a detailed discussion of the securing devices need not be repeated herein. Although shown and described as ratcheting securing devices, clearly other types of securing devices, such as threaded fasteners, other ratchet type devices, clamping devices or the like, or any suitable means for drawing the tables together and securing them together, may be implemented while remaining within the spirit and scope of the present invention.

Figure 23:
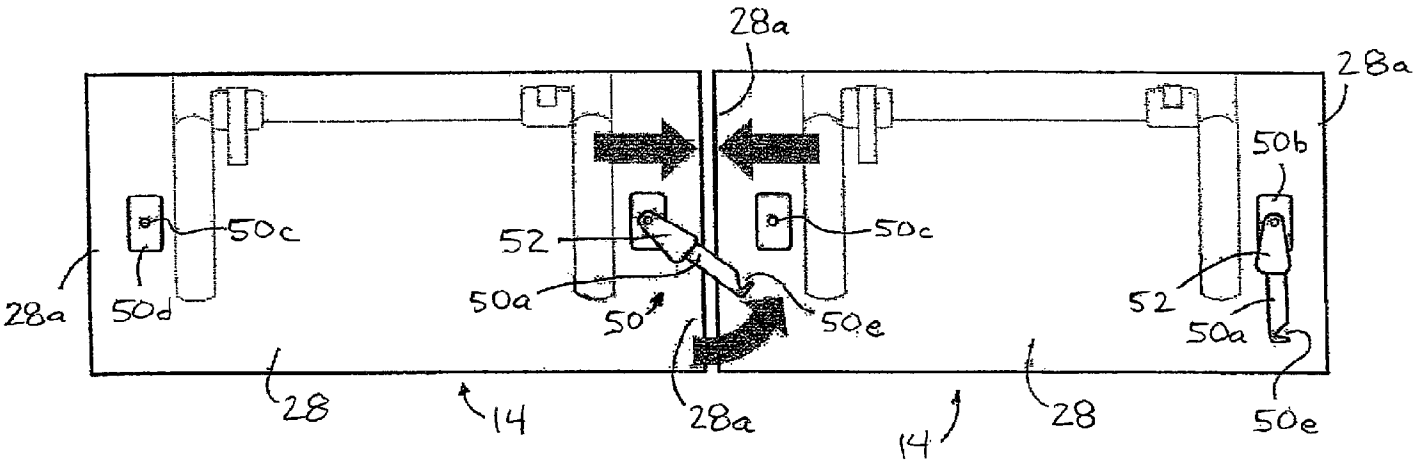
FIGS. 23 and 24 are underside plan views of the latch element of FIGS. 21 and 22 as used to retain the adjacent table tops in an adjacent or abutting configuration.
Figure 24:
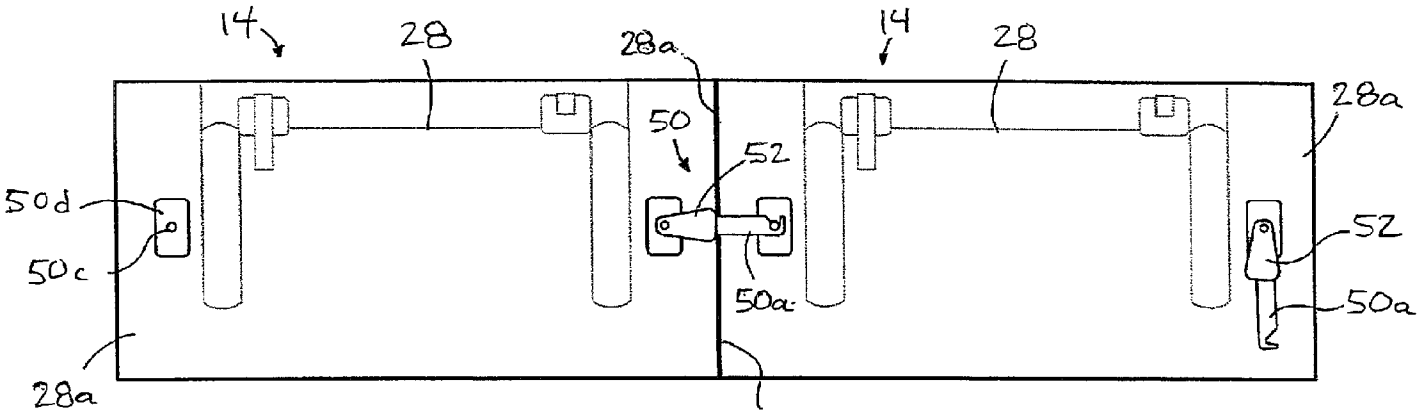

Optionally, and with reference to FIGS. 21-24, a non-ratcheting retaining element or latch element 50 may be provided at one or more locations at the underside of the table tops of the side and/or end tables of the modular table of the present invention. In the illustrated embodiment, the latching device 50 has a latch member 50*a* pivotally mounted to a mounting bracket 50*b* that is mounted at an underside of a table top (such as at an end region of an end table top 28), and a latch pin or protrusion 50*c* protruding from a mounting plate 50*d* that is mounted to an underside of another table top (such as at the opposite end region of the end table top 28). When the table tops are drawn tight together, the latch member 50*a* may be pivoted to engage the latch pin 50*c* (which is received within a notch or slot 50*e* at an end portion of latch member 50*a*) to retain the table tops relative to one another and limit or substantially preclude or substantially close separations or gaps that may otherwise form between the opposed and abutted table tops. Optionally, a handle portion 52 may be attached at the latch member 50*a* to ease the grasping of the latch member by a user to ease pivoting of the latch member when engaging and disengaging the latch pin. As shown in FIGS. 23 and 24, the latch elements 50 may be provided at respective end regions 28*a* of the table top 28 of the end table 14 to facilitate the connection of the two end tables to one another (such as for forming an elongated table out of two end tables). Such a low profile latch element 50 may be preferred at these locations over the ratchet securing device 26, described above, in order to limit interference in the area beneath the end table top so as to enhance the appearance of the assembled table and to avoid a person sitting at the table from hitting the retaining device. When not in use (such as at an end or side of a table unit that is not adjacent an end or side of another table unit), the latch member 50*a* may be removed from its mounting bracket 50*b* or may be pivoted inwardly so as to not extend from the end or side of its table unit (and may be held or retained or secured in its "non-use position").

Accordingly, the present invention provides for a modular table configured from a plurality of individual tables, whereby the legs of at least one or more of the individual tables may be pivoted when the individual table is assembled to the other tables so as to enhance the appearance of the assembled conference table and to provide a more functional table. The tables are secured together such that their table tops are in tight abutment with one another, whereby gaps or separations between the abutted edges of the table tops is limited or substantially precluded by the securing devices, even when the support legs of the end tables are pivoted to the folded-in position and no longer provide vertical support to the outer regions of the end table tops.

Figure 25:
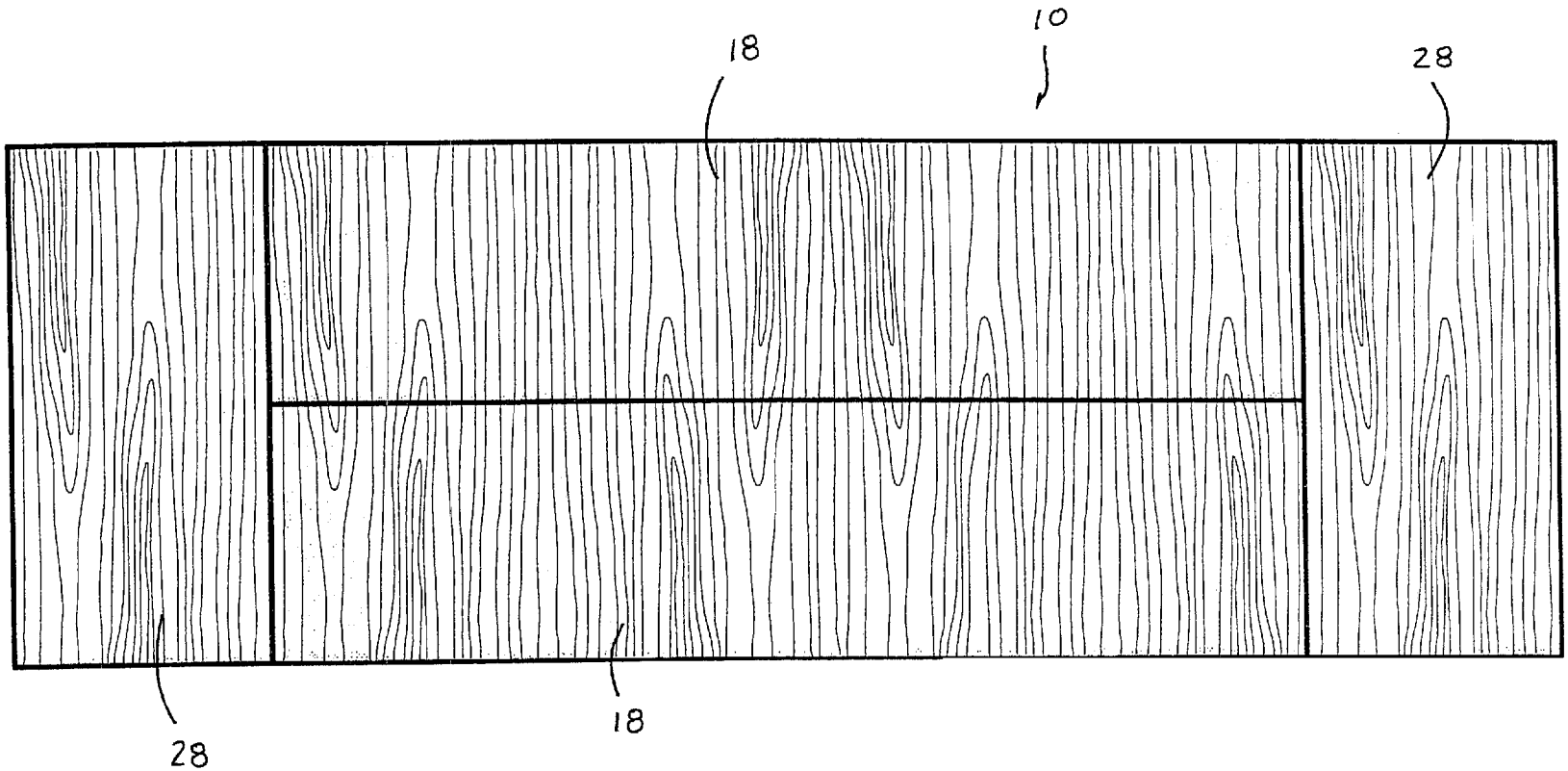
FIG. 25 is a plan view of the table tops of the modular conference table of the present invention, shown with an aligning wood grain finish when assembled together.

Optionally, and as can be seen with reference to FIG. 25, the wood grain or finish of the individual tables may be patterned so that the wood grain patterns (or other selected pattern) of one of the side tables substantially corresponds to the pattern of the other, adjacent side table, whereby the conference table, when the side tables are assembled together as shown in FIG. 24, has a substantially uniform wood grain finish (or other finish or pattern) over substantially its entire surface. Likewise, the end tables may have a wood grain pattern (or other pattern) that may substantially correspond to the wood grain pattern (or other pattern) at the ends of the side tables to provide a substantially uniform or nonbroken pattern across the surface of the assembled conference table and thereby further promote the appearance of a unitary or uniform conference table.

Figure 26:
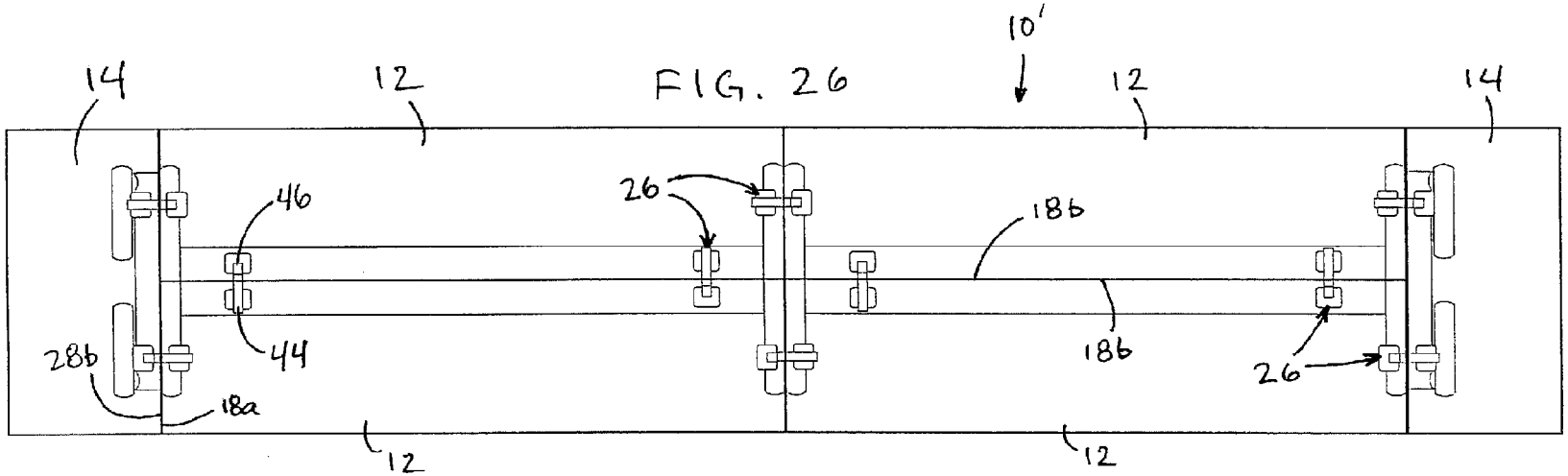
FIG. 26 is a plan view of another modular conference table of the present invention, with four elongated side tables or table sections disposed between the opposite end tables or table sections.
Figure 27:
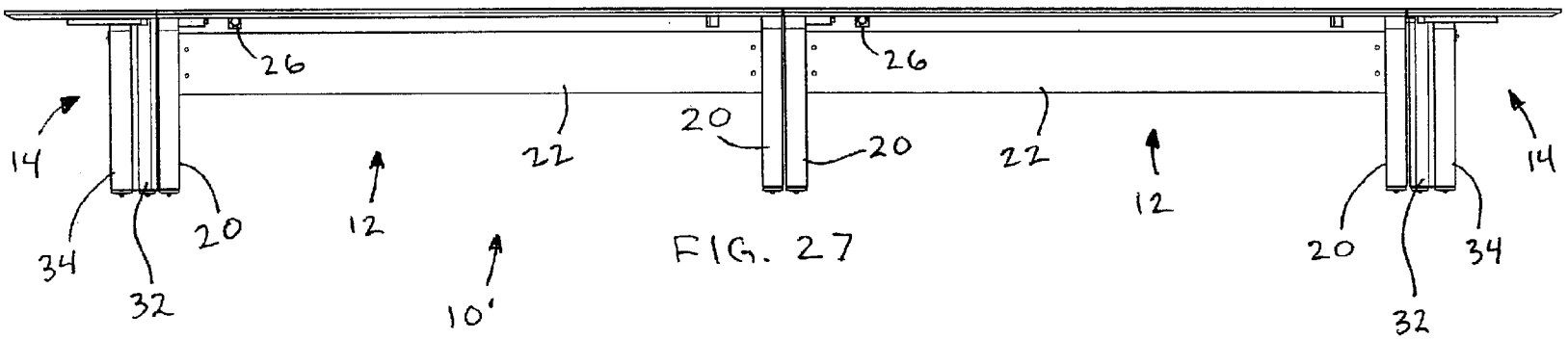
FIG. 27 is a side elevation of the modular conference table of FIG. 26.
Figures 28, 29:
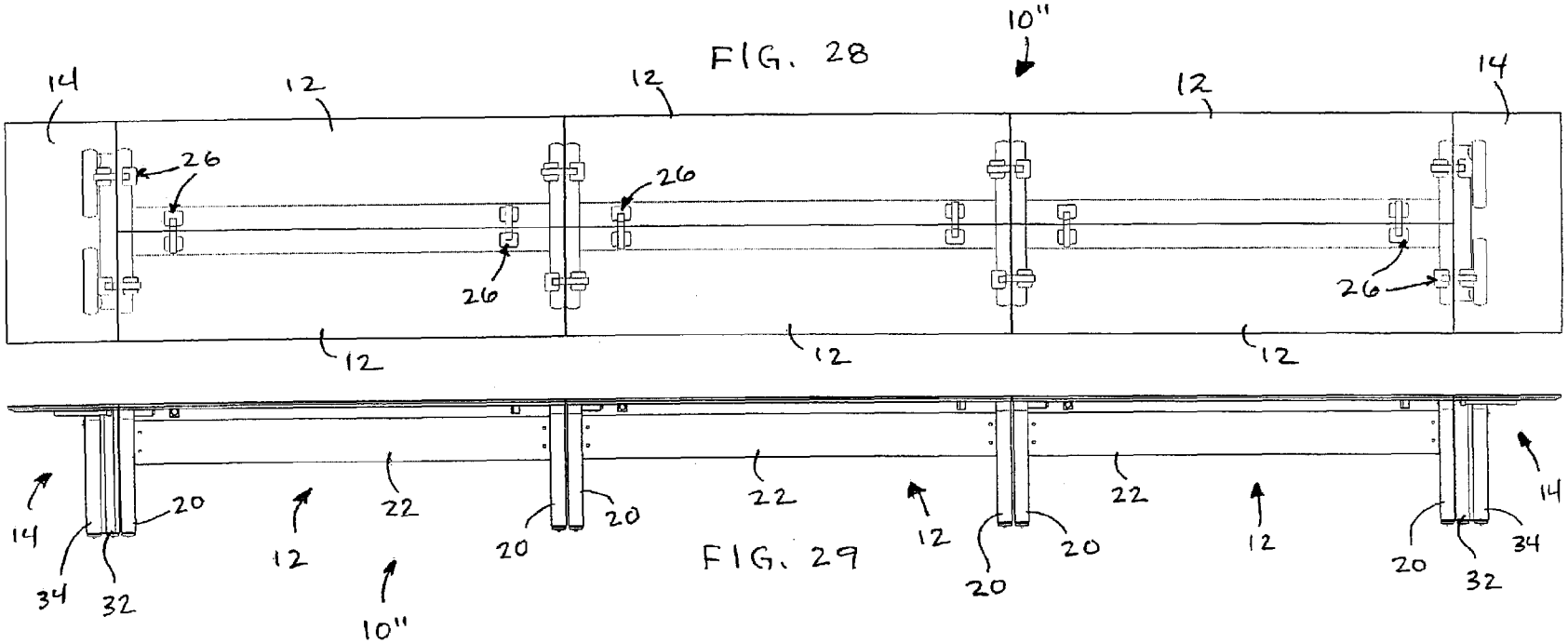
FIG. 28 is a top plan view of another modular conference table of the present invention, with six elongated side tables or table sections disposed between the opposite end tables or table sections.
FIG. 29 is a side elevation of the modular conference table of FIG. 28.

Although shown as forming a conference table having two elongated side tables and two end tables, it is envisioned that other configurations may be implemented without affecting the scope of the present invention. For example, and with reference to FIGS. 26 and 27, a conference table 10' may be formed via four elongated side tables 12 positioned between the two end tables 14, with the opposed ends of the respective side tables being adjoined and secured together via the securing devices 26 (or other suitable securing devices), such as in a similar manner as described above. Optionally, and with reference to FIGS. 28 and 29, a conference table 10" may be formed with six elongated side tables 12 disposed between the opposite end tables 14 and joined together, such as in a similar manner as discussed above. Other numbers of side tables and/or end tables and/or configurations thereof may be implemented while remaining within the spirit and scope of the present invention.

Figures 30A, 30B, 30C, 30D, 30E:
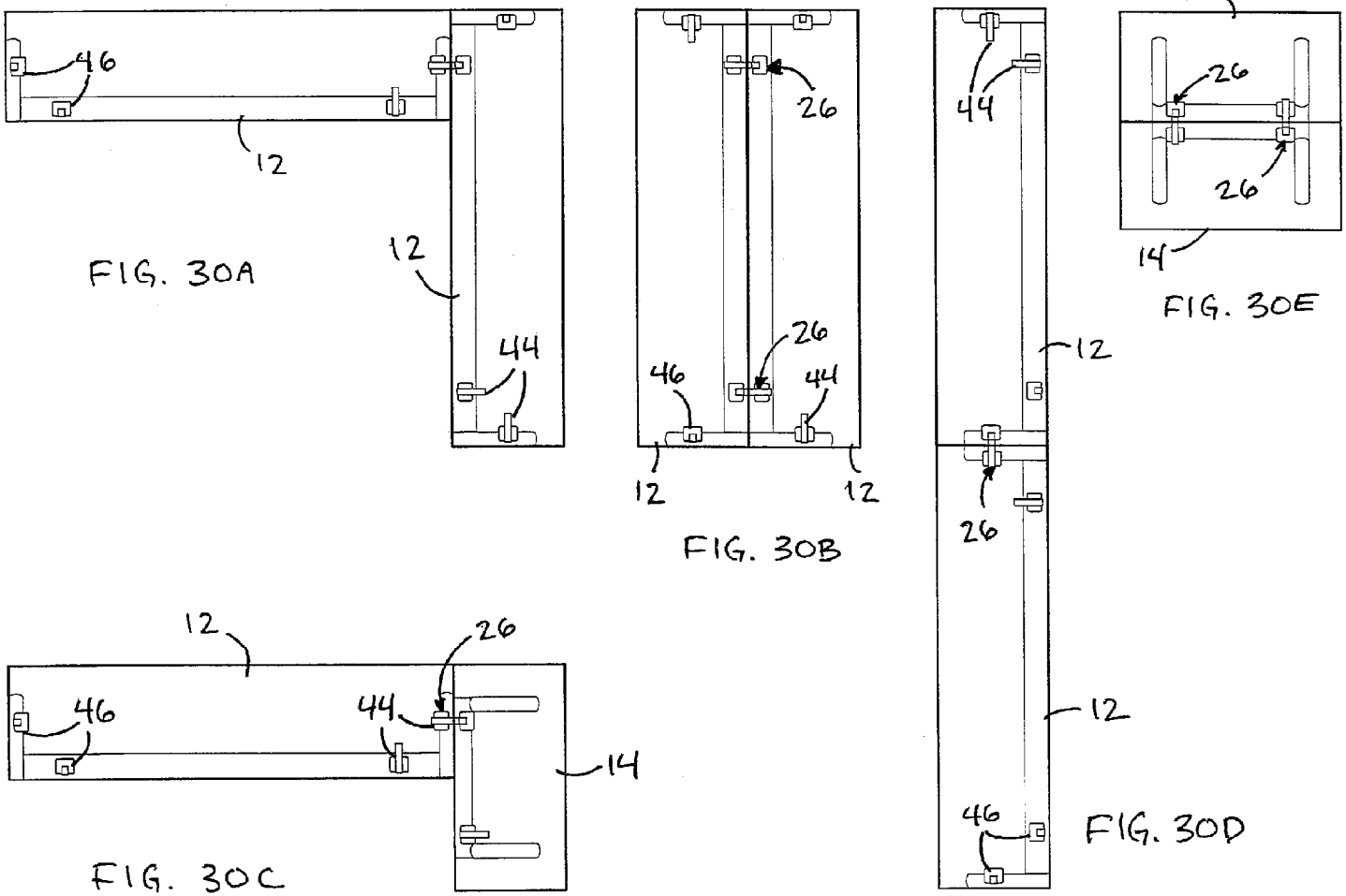
FIGS. 30A-E are top plan views of various configurations in which the tables or table sections of the modular conference table can be arranged in accordance with the present invention.

With reference to FIGS. 30A-E, other configurations may be provided depending on the particular application and desired shape of the assembled tables. In each configuration shown in FIGS. 30A-E, either two side tables are secured together, such as in an L-shaped configuration (FIG. 30A), a side-opposed or side-by-side configuration (FIG. 30B) or an end-opposed or elongated configuration (FIG. 30D), via one or more of the securing devices 26, or an end table 14 may be secured to a single side table 12 to form a generally L-shaped table assembly (FIG. 30C). With reference to FIG. 30E, two end tables may be secured together via the securing devices 26, and optionally (depending on the size and configuration of the table tops and support legs), the pivotable support legs of one or both end tables may be pivoted to their folded-in orientation, so as to provide a pedestal type table assembly. Other configurations of the tables or table sections may be contemplated while remaining within the spirit and scope of the present invention. Although shown in FIGS. 30C and 30E with the support legs of the end tables set to their free-standing support orientation, the legs may be otherwise oriented in those and other table configurations without affecting the scope of the present invention.

Figure 31B:
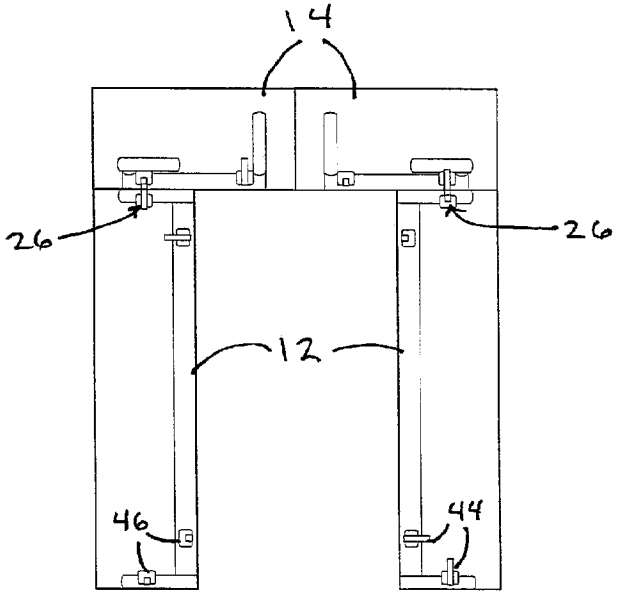
FIGS. 31A-E are top plan views of other configurations of the modular conference table of the present invention.
Figure 31A:
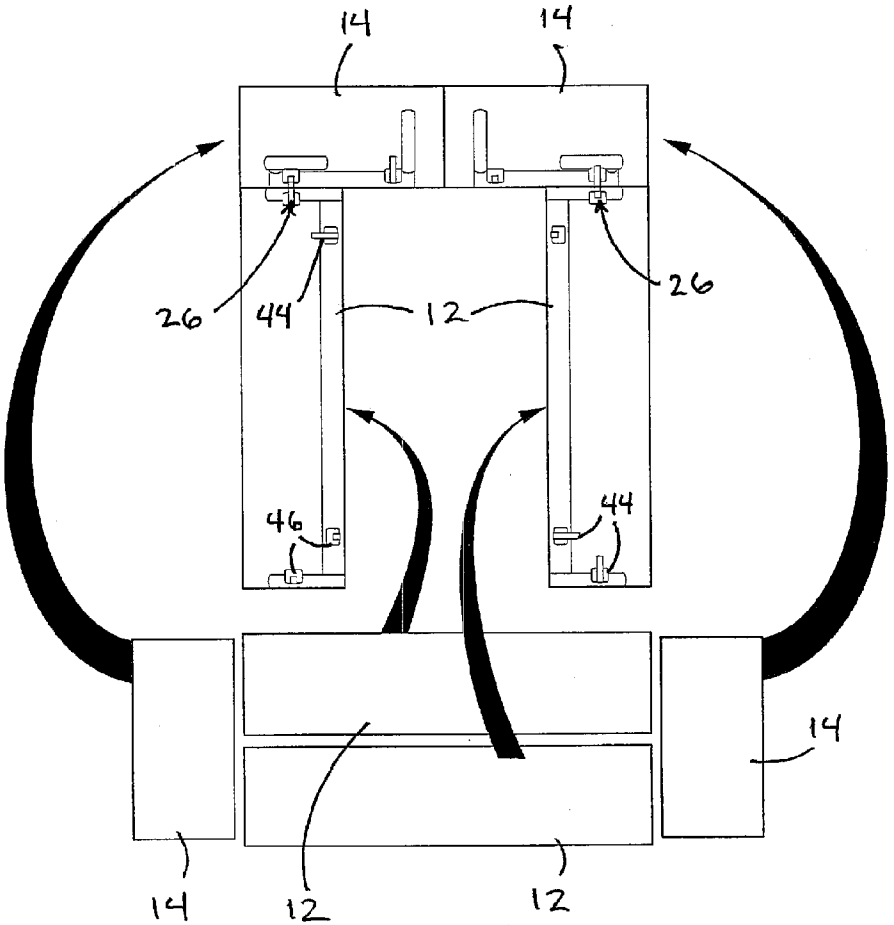
Figure 31E:
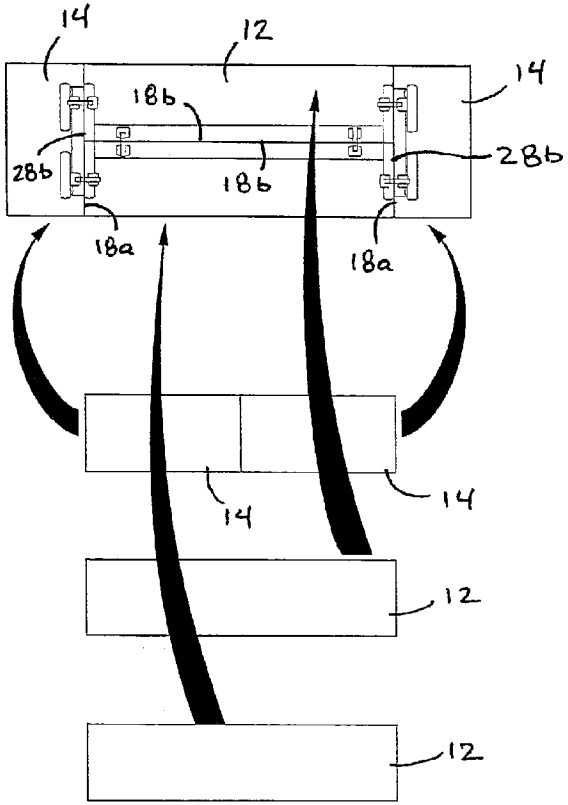
Figure 31D:
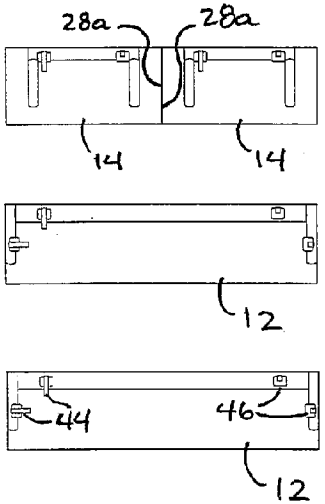
Figure 31C:
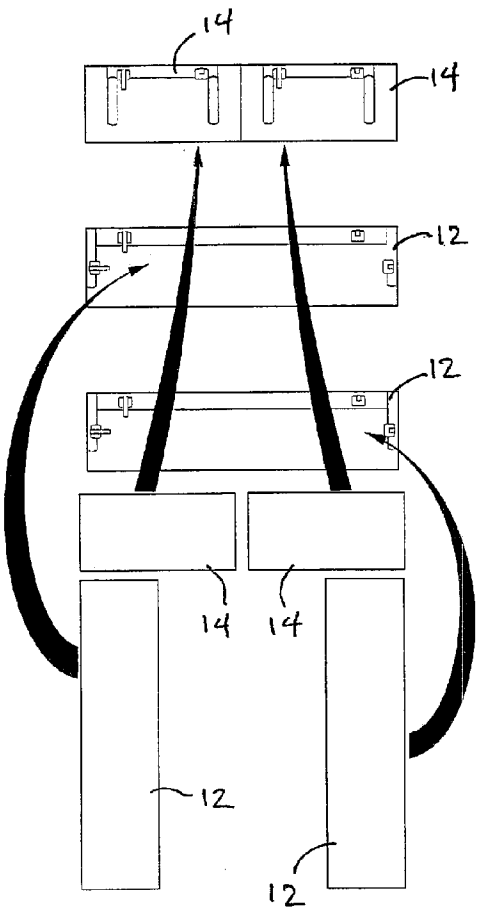

The modular table of the present invention may be readily configured and reconfigured into a variety of shapes or configurations. For example, and with reference to FIGS. 31A-E, the generally rectangular conference table (such as shown in FIG. 1) may be readily configured into a U-shaped conference table, if desired. In such a configuration, the end tables are end-opposed or longitudinally aligned and retained together via the latching device 50 or other suitable securing or retaining device, while each end table is secured to a respective side table via securing devices 26 in a similar manner as described above. Optionally, all four pivotable support legs of the end tables may be pivoted to their folded-in orientation to provide for enhanced seating and appearance of the assembled U-shaped conference table (however, it is envisioned that the folding or pivoting of the center two support legs of the end-opposed end tables may be limited or substantially precluded by the ratchet devices since the center ratchet devices would be in their non-use or non-extended positions and thus may interfere with the pivotal movement of the center support legs). Optionally, the rectangular shaped conference table or the U-shaped conference table may be readily configured into three rows of conference tables, with the two end tables being connected or adjoined end to end or longitudinally aligned, so that each row of tables is substantially the same length (as shown in FIG. 31D). Optionally, in such a configuration, at least the outer pivotable support legs of the elongated table assembly could be pivoted to their free-standing support orientation to support the elongated end table assembly in a free-standing manner, while the inner pivotable support legs could be pivoted to the non-free-standing support orientation. Other configurations may be contemplated while remaining within the spirit and scope of the present invention.

Figure 32:
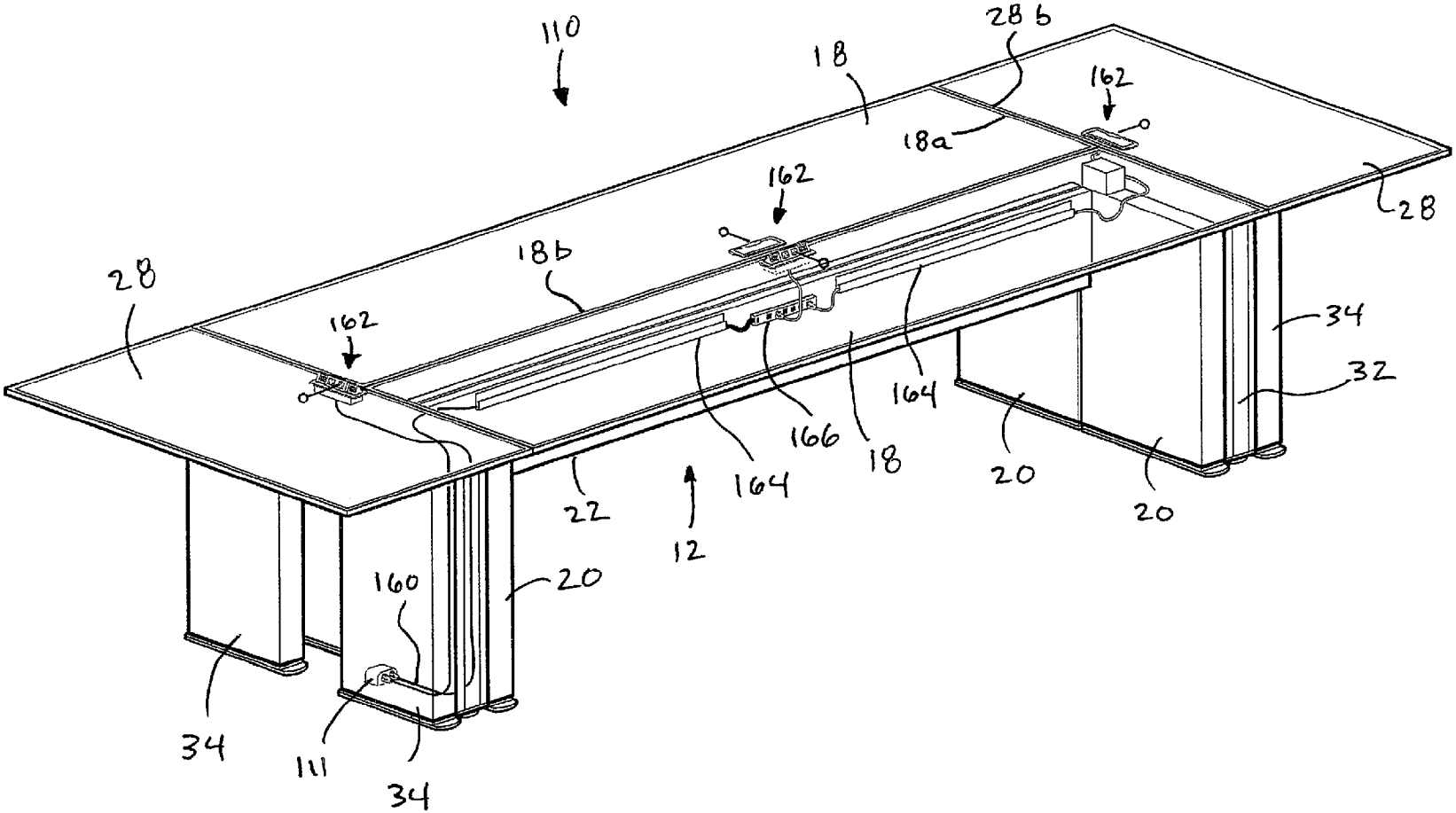
FIG. 32 is a perspective view of another modular conference table of the present invention, showing wire management elements and stowable outlets at the table tops of the tables or table sections in accordance with the present invention.

Optionally, the modular table of the present invention may include wire management elements and/or other power supply or communication ports or the like at one or more of the table tops of the individual tables. For example, and as shown in FIG. 32, a conference table 110 may be positioned at or near a floor outlet or power supply 111 (which may be received or located within the recess or area at the pivotable support legs 34 of one or both end tables 14). Electrical wires 160 (such as power supply wires or cords or data transmission wires or lines or communications wires or lines or the like) may be routed within the space at the end table and may be along the fixed post support 32 and further routed to one or more recessed or stowable outlets or communication ports 162 disposed at or recessed in the surface of one or more of the table tops 18 and/or 28 at the side tables 12 and/or end tables 14, respectively. In the illustrated embodiment, the electrical wires 160 may be routed along a wire management element or channel 164 that extends at least partially along the cross member 22 of the side tables 12 to guide and route the wires at least partially along the length of the side tables. The guide element or channel 164 may terminate at or near a center region of the side table to allow for connection to a power strip or outlet 166 and/or to allow for connection to a recessed or stowable outlet or communication port or the like at a generally central region of the table tops.

Figure 33:
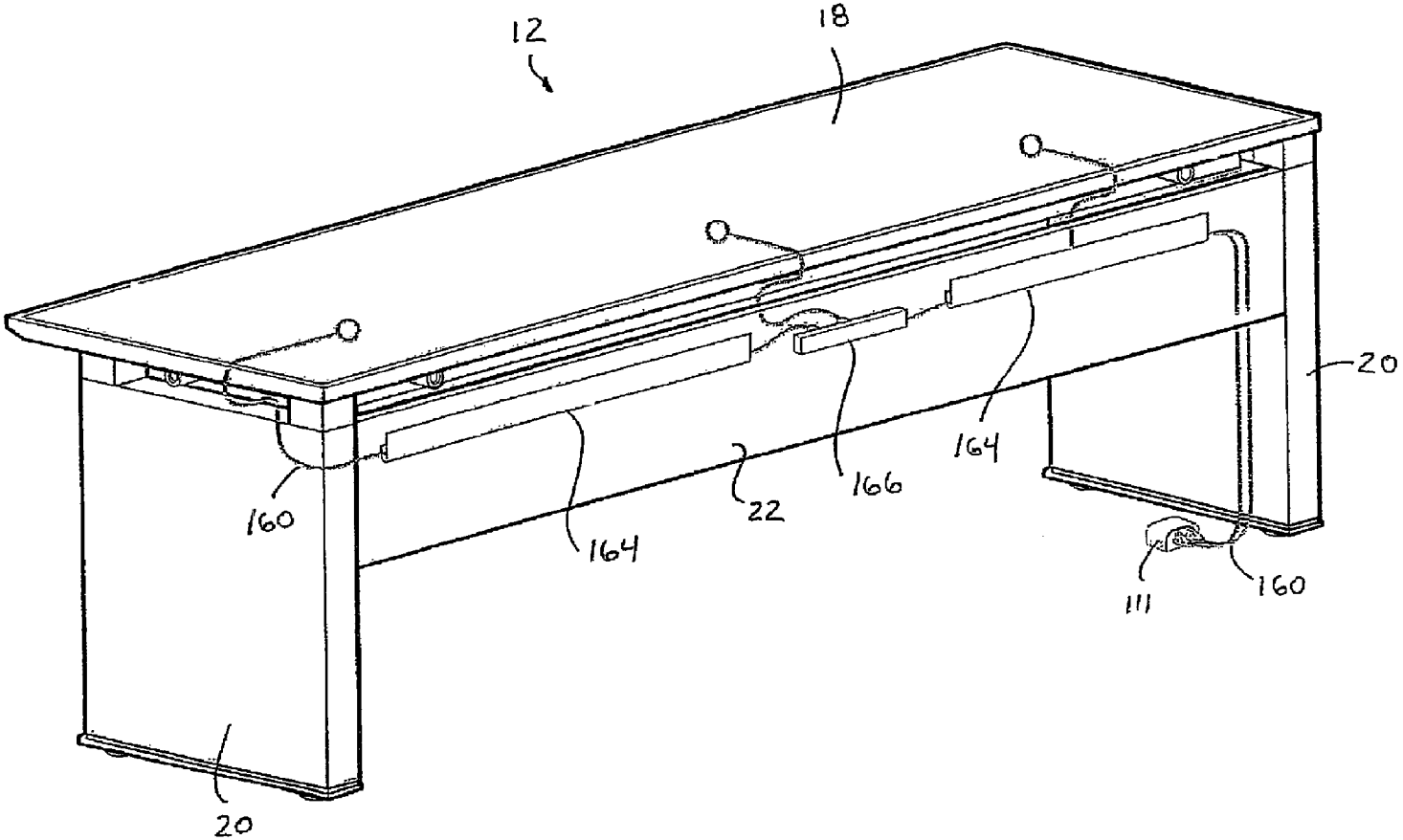
FIG. 33 is a perspective view of a side table or table section with wire management elements and electrical connectors in accordance with the present invention.
Figure 34B:
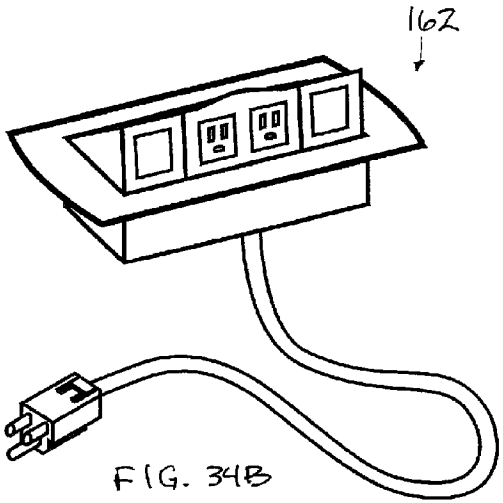
FIGS. 34A-C are perspective views of wire management elements and electrical connectors suitable for use with the modular conference table of the present invention.
Figure 34A:
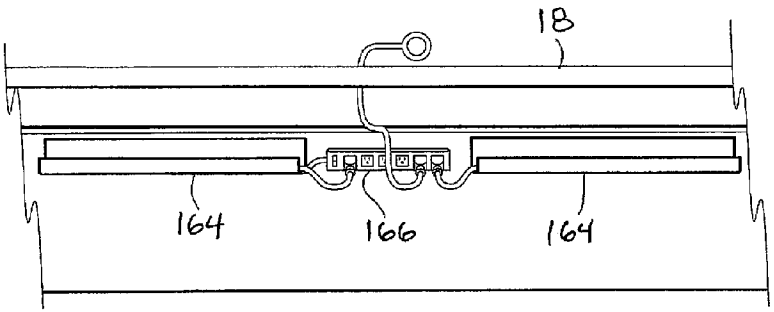
Figure 34C:
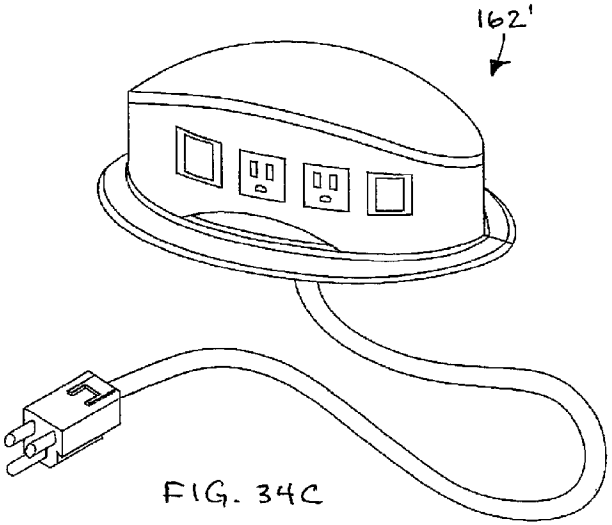

The recessed or stowable outlets or communication ports or data ports may comprise any suitable outlets or ports, such as those described in U.S. patent application Ser. No. 10/858,724, filed Jun. 2, 2004, which is hereby incorporated herein by reference in its entirety. As shown in FIGS. 33 and 34A, the power strip 166 and wire channels or guides 164 (which may be mounted to cross member 22 of side table 12) are suitable for guiding wires 162 and the like to the upper surface of the table top of the side table, such as for when the side table is used independently of the other tables or table sections. As can be seen in FIG. 33, the wires 160 may be routed through the gap or gaps between the upper end of the fixed support legs 20 and the lower surface of the table top 18 or between the upper end of the cross member 22 and the lower surface of the table top 18 of side table 12. Similar wiring configurations may be provided at the end tables as well. As can be seen in FIGS. 34B and 34C, the wire management elements may include, for example, stowable or recessed outlets 162, 162' or other elements for providing power and/or communication connections at the table surface or surfaces.

Therefore, the present invention provides a modular table suitable for use as a conference table. The modular table allows for secure connection of the individual tables or table sections, and allows for adjustment or movement of the legs of the end tables to provide an enhanced appearance to the conference table and to provide a more functional overhang at the end of the conference table. The connection means or securing means of the modular table of the present invention also allows for reconfiguration of the individual tables into a variety of patterns or configurations, depending on the particular application and desired shaped of the finished or assembled table.

Changes and modifications to the specifically described embodiments may be carried out without departing from the principles of the present invention, which is intended to be limited only by the scope of appended claims as interpreted according to the principles of patent law including the doctrine of equivalents.

We claim:

1. A modular table comprising:

a first table having a first table top and a pair of first support legs at opposite end regions of said first table top;

a second table having a second table top and a pair of second support legs spaced apart along a longitudinal axis of said second table, said second support legs being adjustably mounted at said second table top and being adjustable relative to said second table top between a support orientation, wherein said second support legs are oriented to support said second table top in a free-standing manner such that at least one of said second support legs supports said second table top at both sides of said longitudinal axis of said second table, and a non-support orientation, wherein said second support legs do not substantially support said second table top in a free-standing manner, such that said at least one of said second support legs does not support said second table top at both sides of said longitudinal axis of said second table; and wherein said second table is configured to be secured to said first table when said first table is adjacent said second table, whereby said second support legs are adjustable to said second orientation when said second table is secured to said first table, and wherein said second table top is substantially secured relative to and generally coplanar with said first table top when said second table is secured to said first table and when said second support legs are adjusted to said non-support orientation.

2. The modular table of claim 1, wherein said second support legs are adjustable so as to be along a first perimeter region of said second table top when in said non-support orientation, said second support legs being generally parallel to said first support legs when said first table top substantially abuts said first perimeter region of said second table top and when said second table is secured to said first table.

3. The modular table of claim 1, wherein said second support legs are pivotally mounted at said second table top and pivotable about a generally vertical pivot axis.

4. The modular table of claim 3, wherein said first support legs are proximate to opposite ends of said first table top, and wherein said second support legs are inset from respective end regions of said second table top and have their pivot axes generally aligned with a forward edge region of said first support leg when said second table is secured to said first table.

5. The modular table of claim 1 further comprising a pair of first tables, said second table being configured to be secured to each of said first tables at perimeter ends thereof.

6. The modular table of claim 5 further comprising a pair of second tables, each of said second tables being secured to a perimeter end of each of said first tables so that a second table is at each of the opposite ends of said modular table.

7. The modular table of claim 5, wherein said second table has a second length dimension along said longitudinal axis said second table, and each of said first tables has a first length dimension and a first longitudinal axis along said first length dimension, said second table being oriented with said second longitudinal axis being generally transverse to said first longitudinal axes of said first tables when said second table is secured to said first tables.

8. The modular table of claim 7, wherein said second support legs are oriented generally parallel to said longitudinal axis of said second table when in said non-support orientation.

9. The modular table of claim 1 further comprising a securing element for securing said first table to said second table.

10. The modular table of claim 9, wherein said securing element comprises a ratchet element that is actuatable to draw said first table toward said second table and to secure said first table relative to said second table.

11. The modular table of claim 9, wherein said second table top is substantially abutted to said first table top and retained in an abutted orientation via said securing element.

12. The modular table of claim 1, wherein said longitudinal axis of said second table is disposed along a length dimension of said second table top, said second support legs being oriented generally transverse to said longitudinal axis when in said support orientation.

13. The modular table of claim 12, wherein said second support legs are oriented generally parallel to said longitudinal axis of said second table when in said non-support orientation.

14. The modular table of claim 1, wherein each of said second support legs has at least one movable support element for movably supporting said second support legs and said second table at a support surface.

15. The modular table of claim 1, wherein said second table top is generally rectangular in shape.

16. The modular table of claim 1, wherein said at least one second support leg comprises a column support having a width dimension that extends generally transverse to said longitudinal axis of said second table when in said support orientation and that extends generally parallel to said longitudinal axis of said second table when in said non-support orientation.

17. A method of configuring a modular table, said method comprising:

providing a first table having a first table top and a pair of first support legs at opposite end regions of said first table top;

providing a second table having a second table top and a pair of second support legs spaced apart along a longitudinal axis of said second table, said second support legs being adjustably mounted at said second table top and being adjustable relative to said second table top, said second support legs being oriented for free-standing support of said second table top such that at least one of said second support legs supports said second table top at both sides of said longitudinal axis of said second table;

moving at least one of said first and second tables such that a first perimeter region of said first table top is adjacent to a second perimeter region of said second table top;

securing said second table relative to said first table; and moving at least one of said second support legs to a non-support orientation so that said at least one second support leg does not substantially support said second table in a free-standing manner, such that said at least one second support leg does not support said second table top at both sides of said longitudinal axis of said second table, said securement of said second table relative to said first table limiting tilting of said second table when said at least one second support leg is moved to said non-support orientation.

18. The method of claim 17, wherein said second support legs are generally parallel to said second perimeter region of said second table top when in said non-support orientation.

19. The method of claim 17, including pivotally mounting said second support legs at said second table top about respective generally vertical pivot axes, and wherein moving at least one of said second support legs comprises pivoting at least one of said second support legs about at least one respective generally vertical pivot axis.

20. The method of claim 17, wherein providing a first table comprises providing a pair of first tables, said first tables being arranged adjacent one another, and wherein moving said at least one of said first and second tables comprises moving said at least one of said first and second tables such that said second perimeter region of said second table top is adjacent to a first perimeter region of each of said first table tops.

21. The method of claim 20, wherein said second table has a second length dimension along said longitudinal axis, and each of said first tables has a first length dimension and a longitudinal axis along said first length dimension, said second table being oriented with its longitudinal axis being generally transverse to said longitudinal axes of said first tables when said second perimeter region is adjacent to said first perimeter regions.

22. The method of claim 21, wherein moving at least one of said second support legs to a non-support orientation comprises moving said second support legs so that they are oriented generally parallel to said longitudinal axis of said second table.

23. The method of claim 17, wherein securing said second table relative to said first table comprises securing said second table relative to said first table via a ratchet element that is actuatable to draw said first table toward said second table and to secure said first table relative to said second table.

24. The method of claim 23, wherein said second table top is substantially abutted against said first table top and retained in an abutted orientation via said securing element.

25. The method of claim 17, wherein said second table has a second length dimension along said longitudinal axis, and said first table has a first length dimension and a first longitudinal axis along said first length dimension, said second table being oriented with its longitudinal axis generally transverse to said first longitudinal axis of said first table when said second perimeter region is adjacent to said first perimeter region.

26. The method of claim 25, wherein moving at least one of said second support legs to a non-support orientation comprises moving said second support legs so that they are oriented generally parallel to said longitudinal axis of said second table.

27. A modular table comprising:

a first table having a first table top and a pair of first support legs at and proximate to opposite end regions of said first table top;

a second table having a second table top and a pair of second support legs that are spaced apart along a longitudinal axis of said second table and are pivotally mounted at said second table top and pivotable about a respective generally vertical pivot axis, said second support legs being adjustable relative to said second table top between a support orientation wherein said second support legs are oriented to support said second table top in a free-standing manner, such that at least one of said second support legs supports said second table top at both sides of said longitudinal axis of said second table, and a non-support orientation, wherein said second support legs do not substantially support said second table top in a free-standing manner, such that said at least one second support leg does not support said second table top at both sides of said longitudinal axis of said second table;

a securing element adapted to secure said second table to said first table when one of said end regions of said first table top is substantially abutted to a perimeter edge of said second table top, said securing element being adapted to retain said first table top and said second table top in the abutted orientation; and wherein said second support legs are adjustable to said non-support orientation when said end region of said first table top is abutted to said perimeter edge of said second table top and when said second table is secured to said first table, and wherein said second support legs are generally parallel to said first support legs when adjusted to said non-support orientation.

28. The modular table of claim 27, wherein said second table has a length dimension along said longitudinal axis, said second support legs being oriented generally transverse to said longitudinal axis when in said support orientation, and wherein said second support legs are oriented generally parallel to said longitudinal axis of said second table when in said non-support orientation.

* * * * *

UNITED STATES PATENT AND TRADEMARK OFFICE

CERTIFICATE OF CORRECTION

PATENT NO. : 8,096,244 B1
APPLICATION NO. : 12/133097
DATED : January 17, 2012
INVENTOR(S) : Bockheim et al.

It is certified that error appears in the above-identified patent and that said Letters Patent is hereby corrected as shown below:

Column 10
Line 18, “44d” should be --44d'--

Column 15
Line 30, Claim 7, Insert --of-- after “axis”

Signed and Sealed this
Tenth Day of July, 2012

David J. Kappos

David J. Kappos
*Director of the United States Patent and Trademark Office*